US005639590A

United States Patent [19]

Yoshioka

[11] Patent Number: 5,639,590

[45] Date of Patent: Jun. 17, 1997

[54] SILVER HALIDE COLOR PHOTOGRAPHIC LIGHT-SENSITIVE MATERIAL

[75] Inventor: Yasuhiro Yoshioka, Minami-ashigara, Japan

[73] Assignee: Fuji Photo Film Co., Ltd., Kanagawa, Japan

[21] Appl. No.: 59,586

[22] Filed: May 12, 1993

[30] Foreign Application Priority Data

May 14, 1992 [JP] Japan ..... 4-146741

[51] Int. Cl.[6] ..... G03C 7/388; G03C 7/38

[52] U.S. Cl. ..... 430/546; 430/558

[58] Field of Search ..... 430/558, 551, 430/546, 567

[56] References Cited

U.S. PATENT DOCUMENTS

| | | | |
|---|---|---|---|
| 4,749,645 | 6/1988 | Goddard et al. | 430/546 |
| 4,910,126 | 3/1990 | Sato et al. | 430/546 |
| 5,164,289 | 11/1992 | Shimada et al. | 430/558 |
| 5,215,871 | 6/1993 | Sato et al. | 430/558 |
| 5,256,526 | 10/1993 | Suzuki et al. | 430/558 |

FOREIGN PATENT DOCUMENTS

| | | | |
|---|---|---|---|
| 0084692 | 8/1983 | European Pat. Off. | 430/546 |
| 0084694 | 8/1983 | European Pat. Off. | 430/546 |
| 342637 | 11/1989 | European Pat. Off. . | |
| 0465003 | 1/1992 | European Pat. Off. . | |
| 484909 | 5/1992 | European Pat. Off. . | |
| 488248 | 6/1992 | European Pat. Off. . | |
| 491197 | 6/1992 | European Pat. Off. . | |

*Primary Examiner*—Lee C. Wright

*Attorney, Agent, or Firm*—Birch, Stewart, Kolasch & Birch, LLP

[57] ABSTRACT

A silver halide color photographic light-sensitive material contains a specific pyrroloazole-type cyan coupler and a high-boiling organic solvent selected from phosphoric ester, phosphonic ester, phosphinic ester, and phosphine oxide in a cyan forming silver halide emulsion layer formed on a support.

28 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a silver halide color photographic light-sensitive material and, more particularly, to a silver halide color photographic light-sensitive material having good color forming properties and a high color reproducibility.

2. Description of the Related Art

It is common practice to use phenol- or naphthol-based cyan couplers in order to form cyan color images. However, these couplers have undesirable absorption in green- and blue-light regions and hence have a serious problem of impairing the color reproducibilities of particularly blue and green significantly. Therefore, solving this problem has been strongly desired.

As a means for eliminating this problem, 2,4-diphenylimidazole-based cyan couplers are proposed in EP249,453A2. In dyes formed from these couplers, undesirable absorption in green and blue regions is reduced compared to those derived from the phenol- or naphthol-based cyan couplers described above. However, the color reproducibilities of these couplers are still unsatisfactory, and so further improvements have been desired. In addition, these couplers are low in reactivity (i.e., coupling activity) with the oxidized form of a developing agent and have a serious problem that the fastness of the resultant dye against heat and light is very low. For these reasons, these couplers cannot be put into practical use as they are.

Pyrazoloazole-based cyan couplers described in JP-A-64-552 ("JP-A" means Published Unexamined Japanese Patent Application), JP-A-64-553, JP-A-64-554, JP-A-64-555, JP-A-64-556, and JP-A-64-557 are reduced in undesirable absorption in green and blue regions compared to conventional dyes, but the color reproducibilities of these couplers are still insufficient. In addition, these couplers are very poor in color forming properties.

EP456,226A1 discloses a pyrrolopyrazole-based cyan coupler as a coupler capable of yielding dyes excellent in hue. Although this coupler is improved compared to the above cyan couplers in terms of color reproducibility, this improvement is still unsatisfactory, and yet the coupler has a drawback of a large color fog in an unexposed region. Furthermore, the coupler does not reach a satisfactory level also in terms of color forming properties.

Couplers having a 1H-pyrrolo[1,2-b][1,2,4]triazole nucleus are described in Japan Photographic Society Annual Meeting 1985 (at Private College Hall, 23rd and 24th of May, 1985), the Substances of Lectures, pages 108 to 110, JP-A-62-279340, and JP-A-62-278552. All of these couplers are known as magenta couplers. Absorption spectrums of dyes formed from the pyrrolotriazole-based couplers described in Japan Photographic Society, the Substances of Lectures are slightly wider than those of dyes formed from well-known pyrazolotriazole-based magenta couplers. That is, the hues of these couplers are unsatisfactory even as a magenta coupler.

Although couplers having a pyrrolotriazole nucleus are also described in JP-A-62-291646 and JP-A-63-32548, all these couplers are limited to couplers for forming magenta dyes.

On the other hand, various attempts have been made to adjust an absorption wavelength of the formed dye by combining a coupler with a high boiling point organic solvent as a dispersion medium of the coupler. For example, JP-A-1-118131, JP-A-1-156745, and JP-A-2-135442 disclose methods of shifting the absorption wavelength to a longer wavelength side by using phosphoric ester-based high boiling point organic solvents for a pyrazolotriazole-type cyan coupler, an imidazole-type cyan coupler, and a 5,6-fused ring pyrazole-type cyan coupler, respectively, thereby obtaining a more favorable hue. However, since the shifting of wavelength obtained by these methods are small, the effects of the methods are still insufficient.

Examples of a method using phosphonic esters, phosphinic esters, or phosphine oxides in order to improve hue are described in, e.g., JP-A-56-19049, JP-A-63-301941, and JP-A-2-4239. These methods are used primarily to shorten the wavelength at the absorption edge on the long-wavelength side of a yellow coupler or a magenta coupler.

Under the present conditions, however, no sufficiently satisfactory cyan dyes have been obtained yet even by applying the above methods to conventionally known cyan couplers, and so a strong demand has arisen for further improvements.

SUMMARY OF THE INVENTION

It is, therefore, an object of the present invention to develop a cyan dye-forming coupler which can form a cyan dye, in which undesirable side absorption in green- and blue-light regions is reduced, and has good color forming properties, and to provide a silver halide color photographic light-sensitive material which achieves a high color reproducibility by using this cyan dye forming coupler.

The present inventors have found that particularly the above undesirable side absorption can be further reduced by using a pyrroloazole-type cyan coupler represented by Formula (Ia) below together with a high boiling point organic solvent represented by Formula (S) below, and thereby have completed the present invention.

Accordingly, the above object of the present invention is achieved by a silver halide color photographic light-sensitive material having at least a silver halide emulsion layer containing a cyan dye-forming coupler on a support, wherein the silver halide emulsion layer containing the cyan dye-forming coupler contains at least one cyan dye-forming coupler represented by Formula (Ia) below and at least one high boiling point organic solvent represented by Formula (S) below:

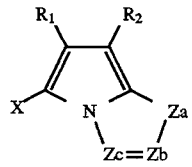

Formula (Ia)

where Za represents —NH— or —CH($R_3$)—, each of Zb and Zc represents —C($R_4$)= or —N=, each of $R_1$, $R_2$, and $R_3$ represents an electron-withdrawing group with a Hammett's substituent constant σp value of 0.20 or more, the sum of the σp values of $R_1$ and $R_2$ being 0.65 or more, $R_4$ represents a hydrogen atom or a substituent, if two $R_4$'s are present in the formula, these $R_4$'s may be the same or different, and X represents a hydrogen atom or a group that splits off upon a coupling reaction with an oxidized form of an aromatic primary amine color developing agent;

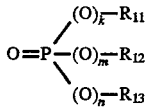

Formula (S)

where each of $R_{11}$, $R_{12}$, and $R_{13}$ represents an alkyl group, a cycloalkyl group, or an aryl group, and each of k, m, and n represents 1 or 0.

A light-sensitive material according to the present invention can have at least one silver halide emulsion layer containing a cyan dye-forming coupler, at least one silver halide emulsion layer containing a magenta dye-forming coupler, and at least one silver halide emulsion layer containing a yellow dye-forming coupler, on a support.

DETAILED DESCRIPTION OF THE PREFERRED EMBODIMENTS

Compounds of the present invention will be described in detail below.

A cyan coupler represented by Formula (Ia) of the present invention is more specifically represented by Formulas (IIa) to (VIIIa) below:

Formulas (IIa) - (VIIIa)

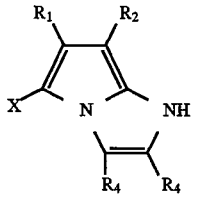

(IIa)

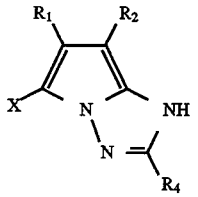

(IIIa)

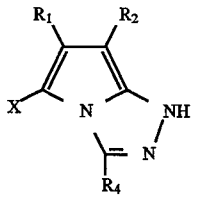

(IVa)

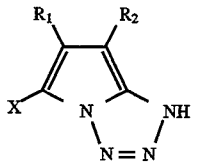

(Va)

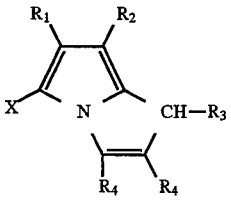

(VIa)

-continued

Formulas (IIa) - (VIIIa)

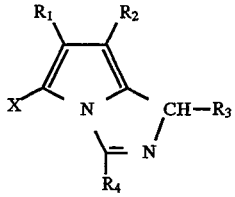

(VIIa)

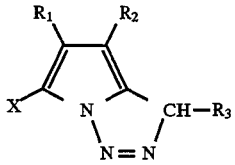

(VIIIa)

where in each formula, $R_1$, $R_2$, $R_3$, $R_4$, and X have the same meanings as in Formula (Ia).

In the present invention, a cyan coupler represented by Formula (IIa), (IIIa), or (IVa), particularly Formula (IIIa) is preferable.

In the cyan coupler of the present invention, each of $R_1$, $R_2$, and $R_3$ is an electron-withdrawing group having a Hammett's substituent constant $\sigma_p$ value of 0.20 or more, and the sum of the $\sigma_p$ values of $R_1$ and $R_2$ is 0.65 or more. The sum of the $\sigma_p$ values of $R_1$ and $R_2$ is preferably 0.70 or more, and its upper limit is about 1.8.

Each of $R_1$, $R_2$, and $R_3$ is an electron-withdrawing group with a Hammett's substituent constant $\sigma_p$ value of 0.20 or more, preferably 0.35 or more, and more preferably 0.60 or more. The $\sigma_p$ value is normally 1.0 or less. The Hammett's rule is an empirical rule proposed by L. P. Hammett in 1935 in order to quantitatively argue the effects of substituents on reaction or equilibrium of benzene derivatives. The rule is widely regarded as appropriate in these days. The substituent constants obtained by the Hammett's rule include a $\sigma_p$ value and a $\sigma_m$ value, and these values are described in a large number of general literature. For example, the values are described in detail in J. A. Dean ed., "Lange's Handbook of Chemistry," the 12th edition, 1979 (McGraw-Hill) and "The Extra Number of The Domain of Chemistry," Vol. 122, pages 96 to 103, 1979 (Nanko Do). In the present invention, each of $R_1$, $R_2$, and $R_3$ is defined by the Hammett's substituent constant $\sigma_p$ value. However, this does not mean that $R_1$, $R_2$, and $R_3$ are limited to substituents having the already known values described in these literature. That is, the present invention includes, of course, values that fall within the above range when measured on the basis of the Hammett's rule even if they are unknown in literature.

Practical examples of $R_1$, $R_2$, and $R_3$, as the electron-withdrawing group with a $\sigma_p$ value of 0.20 or more, are an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with another electron-withdrawing group with a $\sigma_p$ value of 0.20 or more, a heterocyclic group, a halogen atom, an azo group, and a selenocyanato group. Among these substituents, those capable of further having substituents may further have substitutes enumerated later for $R_4$.

$R_1$, $R_2$, and $R_3$ will be described in more detail below. Examples of the electron-withdrawing group with a $\sigma_p$ value of 0.20 or more are an acyl group (e.g., acetyl, 3-phenylpropanoyl, benzoyl, and 4-dodecyloxybenzoyl), an acyloxy group (e.g., acetoxy), a carbamoyl group (e.g., carbamoyl, N-ethylcarbamoyl, N-phenylcarbamoyl, N,N-dibutylcarbamoyl, N-(2-dodecyloxyethyl)carbamoyl, N-(4-n-pentadecanamido)phenylcarbamoyl, N-methyl-N-dodecylcarbamoyl, and N-(3-(2,4-di-t-amylphenoxy) propyl)carbamoyl), an alkoxycarbonyl group (e.g., methoxycarbonyl, ethoxycarbonyl, iso-propyloxycarbonyl, tert-butyloxycarbonyl, iso-butyloxycarbonyl, butyloxycarbonyl, dodecyloxycarbonyl, octadecyloxycarbonyl, diethylcarbamoylethoxycarbonyl, perfluorohexylethoxycarbonyl, and 2-decylhexyloxycarbonylmethoxycarbonyl), an aryloxycarbonyl group (e.g., phenoxycarbonyl and 2,5-amylphenoxycarbonyl), a cyano group, a nitro group, a dialkylphosphono group (e.g., dimethylphosphono), a diarylphosphono group (e.g., diphenylphosphono), a diarylphosphinyl group (e.g., diphenylphosphinyl), an alkylsulfinyl group (e.g., 3-phenoxypropylsulfinyl), an arylsulfinyl group (e.g., 3-pentadecylphenylsulfinyl), an alkylsulfonyl group (e.g., methanesulfonyl and octanesulfonyl), an arylsulfonyl group (e.g., benzenesulfonyl and toluenesulfonyl), a sulfonyloxy group (e.g., methanesulfonyloxy and toluenesulfonyloxy), an acylthio group (e.g., acetylthio and benzoylthio), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a thiocyanato group, a thiocarbonyl group (e.g., methylthiocarbonyl and phenylthiocarbonyl), a halogenated alkyl group (e.g., triphloromethyl and heptafluoropropyl), a halogenated alkoxy group (e.g., trifluoromethyloxy), a halogenated aryloxy group (e.g., pentafluorophenyloxy), a halogenated alkylamino group (e.g., N,N-di-(trifluoromethyl)amino), a halogenated alkylthio group (e.g., difluoromethylthio and 1,1,2,2-tetrafluoroethylthio), an aryl group substituted with another electron-withdrawing group with a $\sigma_p$ value of 0.20 or more (e.g., 2,4-dinitrophenyl, 2,4,6-trichlorophenyl, and pentachlorophenyl), a heterocyclic group (e.g., 2-benzoxazolyl, 2-benzothiazolyl, 1-phenyl-2-benzimidazolyl, 5-chloro-1-tetrazolyl, and 1-pyrrolyl), a halogen atom (e.g., a chlorine atom and a bromine atom), an azo group (e.g., phenylazo), and a selenocyanato group.

Representative examples of the $\sigma_p$ value of the electron-withdrawing group are cyano (0.66), nitro (0.78), trifluoromethyl (0.54), acetyl (0.50), trifluoromethanesulfonyl (0.92), methanesulfonyl (0.72), benzenesulfonyl (0.70), methanesulfinyl (0.49), carbamoyl (0.36), methoxycarbonyl (0.45), pyrazolyl (0.37), methanesulfonyloxy (0.36), dimethoxyphosphoryl (0.60), and sulfamoyl (0.57).

Preferable examples of $R_1$, $R_2$, and $R_3$ are an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkyloxy group, a halogenated alkylthio group, a halogenated aryloxy group, a halogenated aryl group, an aryl group substituted with two or more nitro groups, and a heterocyclic group. Each of $R_1$, $R_2$, and $R_3$ is more preferably an acyl group, an alkoxycarbonyl group, an aryloxycarbonyl group, a nitro group, a cyano group, an arylsulfonyl group, a carbamoyl group, or a halogenated alkyl group, and particularly preferably a cyano group, an alkoxycarbonyl group, an aryloxycarbonyl group, or a halogenated alkyl group.

Each of $R_1$, $R_2$, and $R_3$ is most preferably a cyano group, a trifluoromethyl group, a straight-chain or branched unsubstituted alkoxycarbonyl group, an alkoxycarbonyl group substituted with a carbamoyl group, an alkoxycarbonyl group having an ether bond, or an aryloxycarbonyl group that is either unsubstituted or substituted with an alkyl group or an alkoxy group.

A preferable combination of $R_1$ and $R_2$ is that $R_1$ is a cyano group and $R_2$ is any of a trifluoromethyl group, a straight-chain or branched unsubstituted alkoxycarbonyl group, an alkoxycarbonyl group substituted with a carbamoyl group, an alkoxycarbonyl group having an ether bond, and an aryloxycarbonyl group that is either unsubstituted or substituted with an alkyl group or an alkoxy group.

$R_4$ represents a hydrogen atom or a substituent (including an atom). Examples of the substituent are a halogen atom, an aliphatic group, an aryl group, a heterocyclic group, an alkoxy group, an aryloxy group, a heterocyclicoxy group, an alkylthio, arylthio, or heterocyclic thio group, an acyloxy group, a carbamoyloxy group, a silyloxy group, a sulfonyloxy group, an acylamino group, an alkylamino group, an arylamino group, a ureido group, a sulfamoylamino group, an alkenyloxy group, a formyl group, an alkylacyl, arylacyl, or heterocyclic acyl group, an alkylsulfonyl, arylsulfonyl, or heterocyclic sulfonyl group, an alkylsulfinyl, arylsulfinyl, or heterocyclic sulfinyl group, an alkyloxycarbonyl, aryloxycarbonyl, or heterocyclic oxycarbonyl group, an alkyloxycarbonylamino, aryloxycarbonylamino, or heterocyclic oxycarbonylamino group, a sulfonamido group, a carbamoyl group, a sulfamoyl group, a phosphonyl group, a sulfamido group, an imido group, an azolyl group, a hydroxy group, a cyano group, a carboxy group, a nitro group, a sulfo group, and an unsubstituted amino group. An alkyl group, an aryl group, and a heterocyclic group contained in these groups may be further substituted with the substituents enumerated for $R_4$.

Practical examples of $R_4$ are a hydrogen atom, a halogen atom (e.g., a chlorine atom and a bromine atom), an aliphatic group (e.g., a straight-chain or branched alkyl group, aralkyl group, alkenyl group, alkynyl group, cycloalkyl group, and cycloalkenyl group, having 1 to 36 carbon atoms, more specifically, methyl, ethyl, propyl, isopropyl, t-butyl, tridecyl, 2-methanesulfonylethyl, 3-(3-pentadecylphenoxy) propyl, 3-{4-{2-[4-(4-hydroxyphenylsulfonyl)phenoxy] dodecanami do}phenyl}propyl, 2-ethoxytridecyl, trifluoromethyl, cyclopentyl, and 3-(2,4-di-t-amylphenoxy) propyl), an aryl group (having preferably 6 to 36 carbon atoms, e.g., phenyl, naphthyl, 4-hexadecoxyphenyl, 4-t-butylphenyl, 2,4-di-t-amylphenyl, 4-tetradecanamidophenyl, and 3-(2,4-di-tert-amylphenoxyacetamido)phenyl), a heterocyclic group (e.g., 3-pyridyl, 2-furyl, 2-thienyl, 2-pyridyl, 2-pyrimidinyl, and 2-benzothiazolyl), an alkoxy group (e.g., methoxy, ethoxy, 2-methoxyethoxy, 2-dodecyloxyethoxy, and 2-methanesulfonylethoxy), an aryloxy group (e.g., phenoxy, 2-methylphenoxy, 4-tert-butylphenoxy, 2,4-d-tert-amylphenoxy, 2-chlorophenoxy, 4-cyanophenoxy, 3-nitrophenoxy, 3-t-butyloxycarbamoylphenoxy, and 3-methoxycarbamoylphenoxy), a heterocyclic oxy group (e.g., 2-benzimidazolyloxy, 1-phenyltetrazole-5-oxy, and 2-tetrahydropyranyloxy), an alkylthio, arylthio, or heterocyclic thio group (e.g., methylthio, ethylthio, octylthio, tetradodecylthio, 2-phenoxyethylthio, 3-phenoxypropylthio, 3-(4-tert-butylphenoxy)propylthio, phenylthio, 2-butoxy-5-tert-octylphenylthio, 3-pentadecylphenylthio, 2-carboxyphenylthio, 4-tetradecanamidophenylthio, 2-benzothiazolylthio, 2,4-di-phenoxy-1,3,4-triazole-6-thio, and 2-pyridylthio), an acyloxy group (e.g., acetoxy and hexadecanoyloxy), a carbamoyloxy group (e.g., N-ethylcarbamoyloxy and N-phenylcarbamoyloxy), a silyloxy group (e.g., trimethylsilyloxy and dibutylmethylsilyloxy), a sulfonyloxy group (e.g., dodecylsulfonyloxy), an acylamino group (e.g., acetamido, benzamido, tetradecanamido, 2-(2,4-di-tert-amylphenoxyacetamido, 2-[4-(4-hydroxyphenylsulfonyl) phenoxy]decanamido, isopentadecanamido, 2-(2,4-di-t-amylphenoxy)butanamido, 4-(3-t-butyl-4-hydroxyphenoxy) butanamido), an alkylamino group (e.g., methylamino, butylamino, dodecylamino, dimethylamino, diethylamino, and methylbutylamino), an arylamino group (e.g., phenylamino, 2-chloroanilino, 2-chloro-5-tetradecanamidoanilino, N-acetylanilino, 2-chloro-5-[α-(2-tert-butyl-4-hydroxyphenoxy)dodecanamido]anilino, and 2-chloro-5-dodecyloxycarbonylanilino), a ureido group (e.g., methylureido, phenylureido, N,N-dibutylureido, and dimethylureido), a sulfamoylamino group (e.g., N,N-dipropylsulfamoylamino and N-methyl-N-decylsulfamoylamino), an alkenyloxy group (e.g., 2-propenyloxy), a formyl group, an alkylacyl, arylacyl, or heterocyclic acyl group (e.g., acetyl, benzoyl, 2,4-di-tert-amylphenylacetyl, 3-phenylpropanoyl, and 4-dodecyloxybenzoyl), an alkylsulfonyl, arylsulfonyl, or heterocyclic sulfonyl group (e.g., methanesulfonyl, octanesulfonyl, benzenesulfonyl, and toluenesulfonyl), a sulfinyl group (e.g., octanesulfinyl, dodecylsulfinyl, dodecanesulfinyl, phenylsulfinyl, 3-pentadecylphenylsulfinyl, and 3-phenoxypropylsulfinyl), an alkyloxycarbonyl, aryloxycarbonyl, or heterocyclic oxycarbonyl group (e.g., methoxycarbonyl, butoxycarbonyl, dodecyloxycarbonyl, octadecyloxycarbonyl, phenyloxycarbonyl, and 2-pentadecyloxycarbonyl), an alkyloxycarbonylamino, aryloxycarbonylamino, or heterocyclic oxycarbonylamino group (e.g., methoxycarbonylamino, tetradecyloxycarbonylamino, phenoxycarbonylamino, and 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, and 2-methoxy-5-tertbutylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, and N-[3-(2,4-di-tert-amylphenoxy) propyl]carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a phosphonyl group (e.g., phenoxyphosphonyl, octyloxyphosphonyl, and phenylphosphonyl), a sulfamido group (e.g., dipropylsulfamoylamino), an imido group (e.g., N-succinimido, hydantoinyl, N-phthalimido, and 3-octadecylsuccinimido), an azolyl group (e.g., imidazolyl, pyrazolyl, 3-chloro-pyrazol-1-yl, and triazolyl), a hydroxy group, a cyano group, a carboxy group, a nitro group, a sulfo group, and an unsubstituted amino group.

Preferable examples of $R_4$ are an alkyl group, an aryl group, a heterocyclic group, a cyano group, a nitro group, an acylamino group, an arylamino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryloxycarbonyl group, a heterocyclicoxy group, an acyloxy group, a carbamoyloxy group, an aryloxycarbonylamino group, an imido group, a heterocyclic thio group, a sulfinyl group, a phosphonyl group, an acyl group, and an azolyl group.

$R_4$ is more preferably an alkyl group or an aryl group, particularly preferably an alkyl group or an aryl group that has at least one substituent selected from alkoxy, sulfonyl, sulfamoyl, carbamoyl, acylamido and sulfonamido groups, and most preferably an alkyl group or an aryl group that has at least one substituent selected from acylamido and sulfonamido groups.

In Formula (Ia), X represents a hydrogen atom or a group (to be referred to as a "split-off" group hereinafter) that splits off upon reacting with the oxidized form of an aromatic primary amine color developing agent. When X represents the split-off group, this split-off group is a halogen atom, an aromatic azo group, an alkyl group that bonds to a coupling position through an oxygen, nitrogen, sulfur or carbon atom, an aryl group, a heterocyclic group, an alkylsulfonyl or arylsulfonyl group, an arylsulfinyl group, an alkoxycarbonyl, aryloxycarbonyl or heterocyclic oxycarbonyl group, an alkylcarbonyl, arylcarbonyl or heterocyclic carbonyl group, or a heterocyclic group that bonds to a coupling position through a nitrogen atom in the heterocyclic ring. More specifically, examples of the split-off group are a halogen atom, an alkoxy group, an aryloxy group, an acyloxy group, an alkylsulfonyloxy or arylsulfonyloxy group, an acylamino group, an alkylsulfonamide or arylsulfonamide group, an alkoxycarbonyloxy group, an aryloxycarbonyloxy group, an alkylthio, arylthio or heterocyclic thio group, a carbamoylamino group, an arylsulfonyl group, an arylsulfinyl group, a 5- or 6-membered nitrogen-containing heterocyclic group, an imido group, and an arylazo group. An alkyl group, an aryl group, or a heterocyclic group contained in these split-off groups may be further substituted with the substituents for $R_4$. If two or more of these substituents are present, they may be the same or different and can further have the substituents enumerated above for $R_4$.

Practical examples of the split-off group are a halogen atom (e.g., a fluorine atom, a chlorine atom, and a bromine atom), an alkoxy group (e.g., ethoxy, dodecyloxy, methoxyethylcarbamoylmethoxy, carboxypropyloxy, methylsulfonylethoxy, and ethoxycarbonylmethoxy), an aryloxy group (e.g., 4-methylphenoxy, 4-chlorophenoxy, 4-methoxyphenoxy, 4-carboxyphenoxy, 3-ethoxycarboxyphenoxy, 3-acetylaminophenoxy, and 2-carboxyphenoxy), an acyloxy group (e.g., acetoxy, tetradecanoyloxy, and benzoyloxy), an alkylsulfonyloxy or arylsulfonyloxy group (e.g., methanesulfonyloxy and toluenesulfonyloxy), an acylamino group (e.g., dichloroacetylamino and heptafluorobutyrylamino), an alkylsulfonamido or arylsulfonamido group (e.g., methanesulfonamino, trifluoromethanesulfonamino, and p-toluenesulfonylamino), an alkoxycarbonyloxy group (e.g., ethoxycarbonyloxy and benzyloxycarbonyloxy), an aryloxycarbonyloxy group (e.g., phenoxycarbonyloxy), an alkylthio, arylthio or heterocyclic thio group (e.g., ethylthio, 2-carboxyethylthio, dodecylthio, 1-carboxydodecylthio, phenylthio, 2-butoxy-5-t-octylphenylthio, and tetrazolylthio), an arylsulfonyl group (e.g., 2-butoxy-5-tert-octylphenylsulfonyl), an arylsulfinyl group (e.g., 2-butoxy-5-tert-octylphenylsulfinyl), a carbamoylamino group (e.g., N-methylcarbamoylamino and N-phenylcarbamoylamino), a 5- or 6-membered nitrogen-containing heterocyclic group (e.g., imidazolyl, pyrazolyl, triazolyl, tetrazolyl, and 1,2-dihydro-2-oxo-1-pyridyl), an imido group (e.g., succinimido and hydantoinyl), and an arylazo group (e.g., phenylazo and 4-methoxyphenylazo). These groups may be further substituted with the substituents enumerated for $R_4$. Another example of a split-off group that bonds through a carbon atom is a bis-type coupler obtained by condensing a 4-equivalent coupler with aldehydes or ketones. The split-off groups of the present invention can contain photographically useful groups, such as development inhibitors and development accelerators.

X is preferably a halogen atom, an alkoxy group, an aryloxy group, an alkylthio or arylthio group, an arylsulfonyl group, an arylsulfinyl group, or a 5- or 6-membered nitrogen-containing heterocyclic group that bonds to a coupling active position through a nitrogen atom. X is more preferably an arylthio group.

In a cyan coupler represented by Formula (Ia), the group represented by $R_1$, $R_2$, $R_3$, $R_4$, or X may contain the moiety of a cyan coupler represented by Formula (Ia) to form a dimmer or a higher-order polymer, or may contain a polymer chain to form a homopolymer or a copolymer. A typical example of the homopolymer or copolymer that contains a polymer chain is a homopolymer or copolymer of an addition-polymerizable ethylenically unsaturated compound having a cyan coupler moiety represented by Formula (Ia). In this case, one or more types of cyan color-forming repeating units having a cyan coupler moiety represented by Formula (Ia) may be contained in that polymer. The copolymer may also contain, as copolymer components, one or more types of non-color-forming ethylenic monomers that do not couple with the oxidized form of an aromatic primary amine developing agent, such as acrylic ester, methacrylic ester, and maleic ester.

Practical examples of the coupler of the present invention are given below, but the present invention is not limited to these examples.

(1)
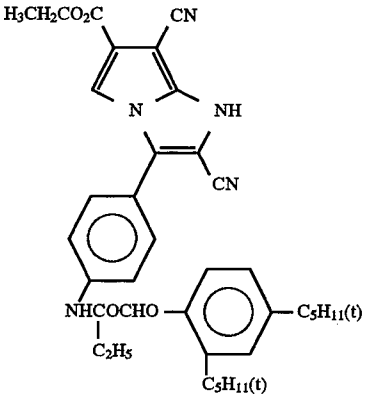
(2)
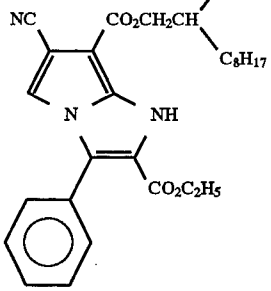

-continued
(3)
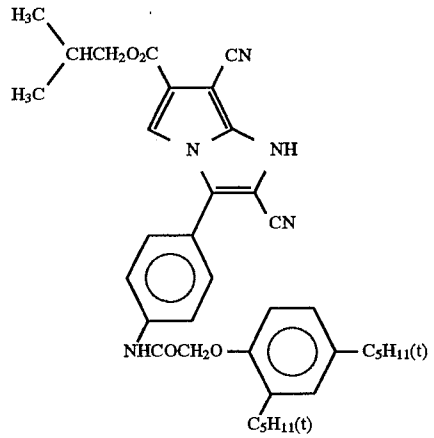
(4)
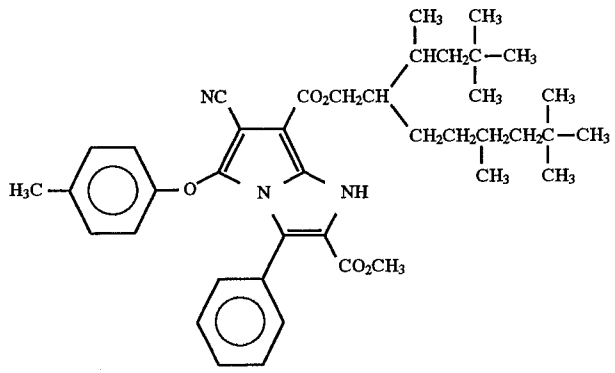

-continued
(5)
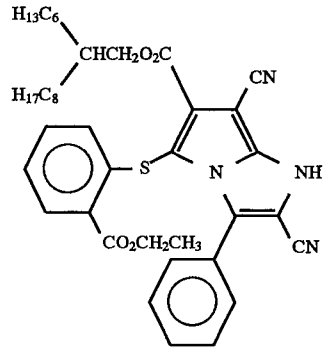
(6)
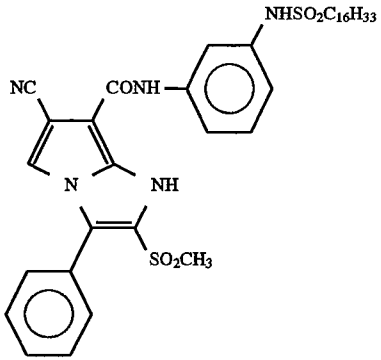
(7)
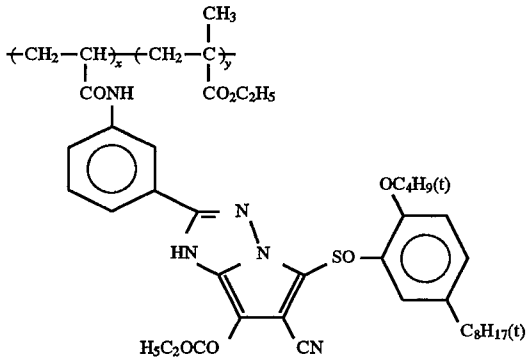
x:y = 50:50
(molar ratio)

-continued
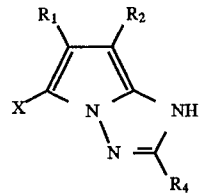
| No. | $R_1$ | $R_2$ | $R_4$ | X |
|---|---|---|---|---|
| 8 | $CO_2CH_3$ | CN | 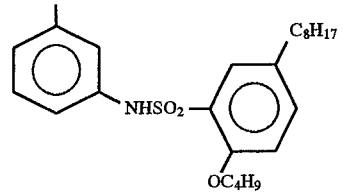 | H |
| 9 | CN | 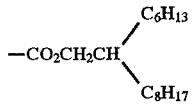 | 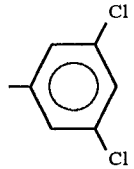 | H |
| 10 | CN | 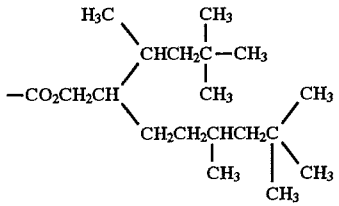 | 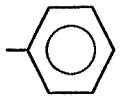 | H |
| 11 | CN | 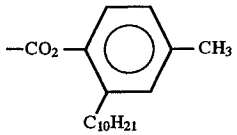 | 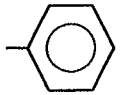 | H |

-continued
| | | | | |
|---|---|---|---|---|
| 12 | CN | 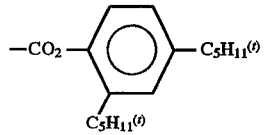 | 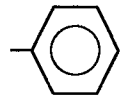 | H |
| 13 | CN | 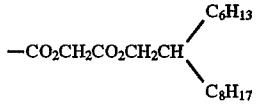 | 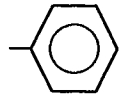 | H |
| 14 | CN | $-CO_2CH_2CH_2(CF_2)_6F$ | 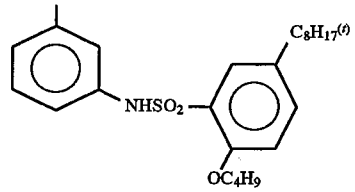 | H |
| 15 | CN | 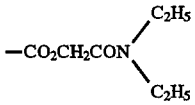 | 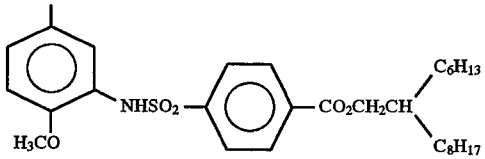 | 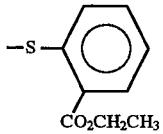 |
| 16 | CN | $-CO_2CH_2CH_2(CF_2)_6F$ | 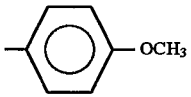 | 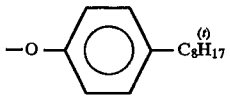 |
| 17 | CN | 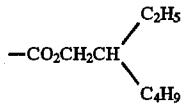 | 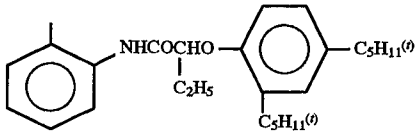 | 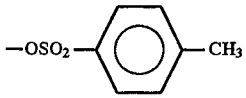 |
| 18 | CN | 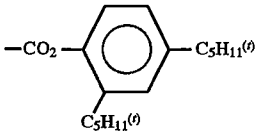 | 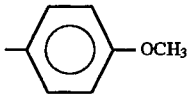 | 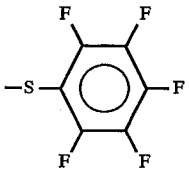 |

-continued
| | | | | |
|---|---|---|---|---|
| 19 | CN | $-CO_2CH_2CH(CH_3)_2$ | $-NHCONH-C_6H_4-NHSO_2C_{16}H_{33}$ (Cl) | 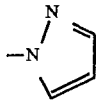 |
| 20 | CN | $-CO_2CH_2(CF_2)_4H$ | $-NHCOCHO(C_6H_{13})-C_6H_4-C_5H_{11}^{(t)}$ ($C_5H_{11}^{(t)}$) | 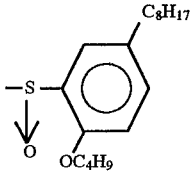 |
| 21 | CN | $-CO_2CH_2CH(C_8H_{17})(C_6H_{13})$ | $-C_6H_4-NHSO_2-C_6H_4-OC_4H_9$ ($C_8H_{17}^{t}$) | H |
| 22 | $-CO_2-C_6H_4-C_8H_{17}^{(t)}$ ($C_8H_{17}^{(t)}$) | CN | $-C(CH_3)_3$ | $-O-C_6H_4-CO_2CH_2CH_3$ |
| 23 | $-CO_2CH_2C_6F_{13}$ | CN | $-C_6H_4-NHCOCH_2O-C_6H_4-C_5H_{11}^{(t)}$ ($C_5H_{11}^{(t)}$) | Cl |
| 24 | $-SO_2-C_6H_5$ | $-CO_2CH_2CH(CH_2CH(CH_3)_2)(CH_2CH_2CH(CH_3)CH_2C(CH_3)_3)$ | $CH_3$ | $-OCOCH_3$ |

-continued
| | | | | |
|---|---|---|---|---|
| 25 | CN | $-CO_2CH_2CO_2CH_3$ | 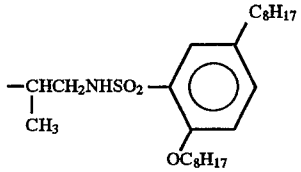 | 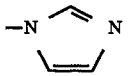 |
| 26 | CN | 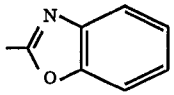 | 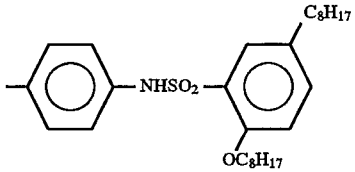 | 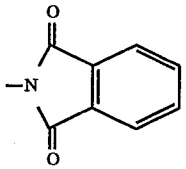 |
| 27 | CN | $CF_3$ | 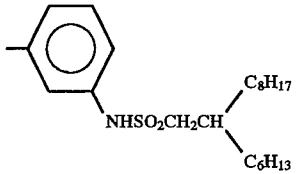 | Cl |
| 28 | 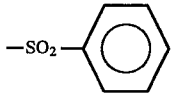 | $CF_3$ | 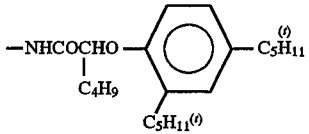 | F |
| 29 | CN | 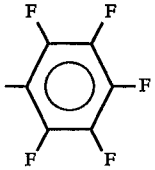 | 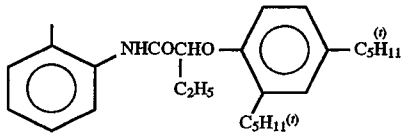 | 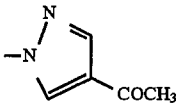 |
| 30 | 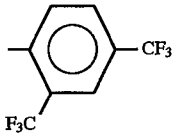 | $-SO_2Ph$ | 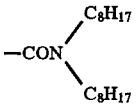 | 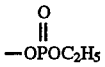 |

-continued
| | | | | |
|---|---|---|---|---|
| 31 | CN | 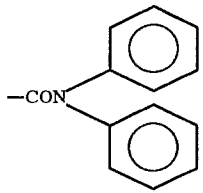 | 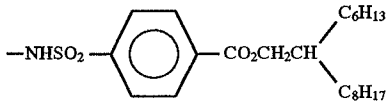 | 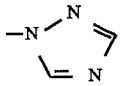 |
| 32 | CN | 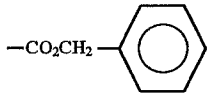 | 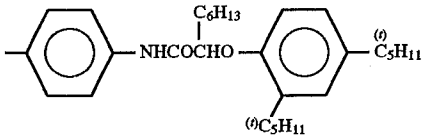 | H |
| 33 | CN | 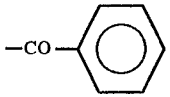 | 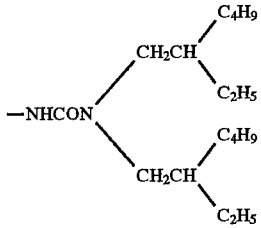 | $-OSO_2CH_3$ |
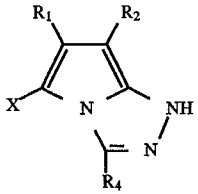
| No. | $R_1$ | $R_2$ | $R_4$ | X |
|---|---|---|---|---|
| 34 | $-CO_2C_2H_5$ | CN | 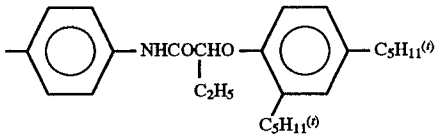 | Cl |

-continued
| | | | | |
|---|---|---|---|---|
| 35 | CN | 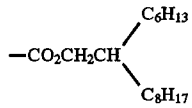 | 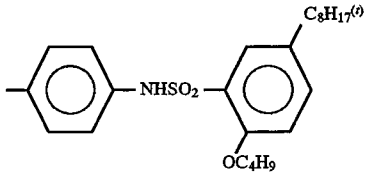 | H |
| 36 | CN | $-CO_2CH_2CH_2(CF_2)_6F$ | 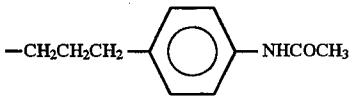 | 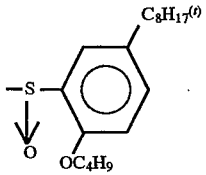 |
| 37 | CN | 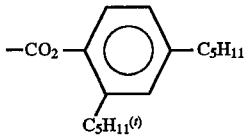 | 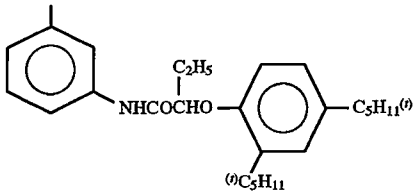 | 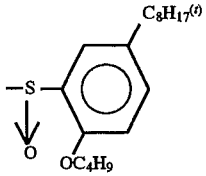 |
| 38 | CN | 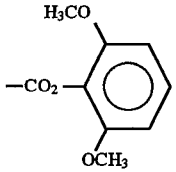 | 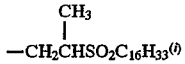 | 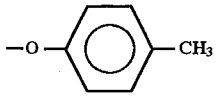 |
| 39 | CN | 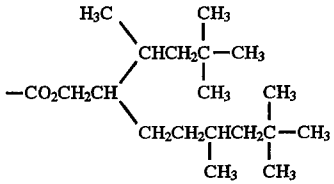 | 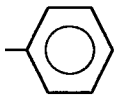 | H |
| 40 | CN | 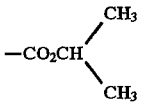 | 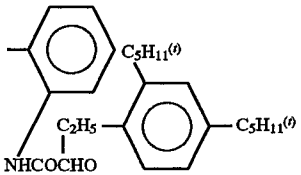 | Cl |

-continued
| | | | | |
|---|---|---|---|---|
| 41 | CN | $-CON(C_2H_5)_2$ | 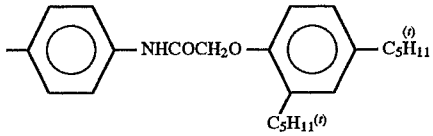 | $-OSO_2CH_3$ |
(42)
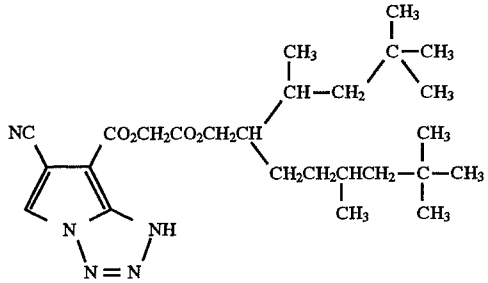
(43)
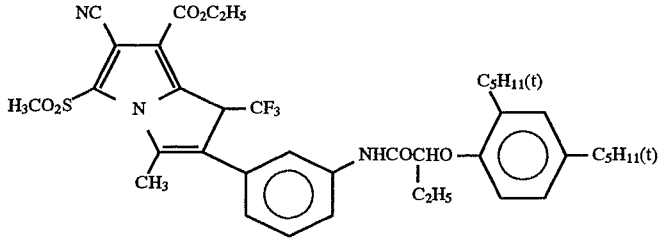
(44)
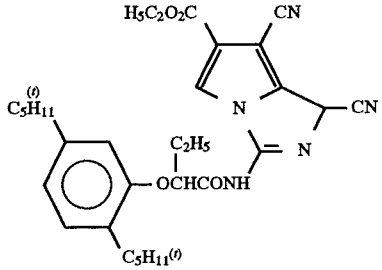

-continued
(45)
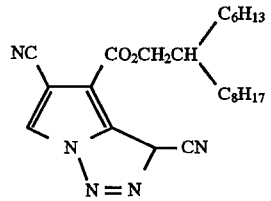
(46)
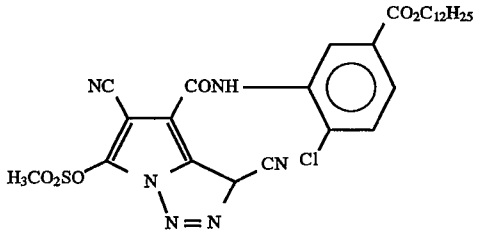

The cyan couplers and their intermediates according to the present invention can be synthesized by conventional methods, such as those described in J. Am. Chem. Soc., 80, 5332 (1958), J. Ame. Chem., 81, 2452 (1959), J. Am. Chem. Soc., 112, 2465 (1990), Org. Synth., 1270 (1941), J. Chem. Soc., 5149 (1962), Heterocyclic., 27, 2301 (1988), and Rec. Tray. Chim., 80, 1075 (1961), the literature cited in these methods, and methods similar to these methods.

Examples of synthesis will be described below.

(Synthesis Example 1) Synthesis of exemplified compound (9)

A exemplified compound (9) was synthesized through the following route.

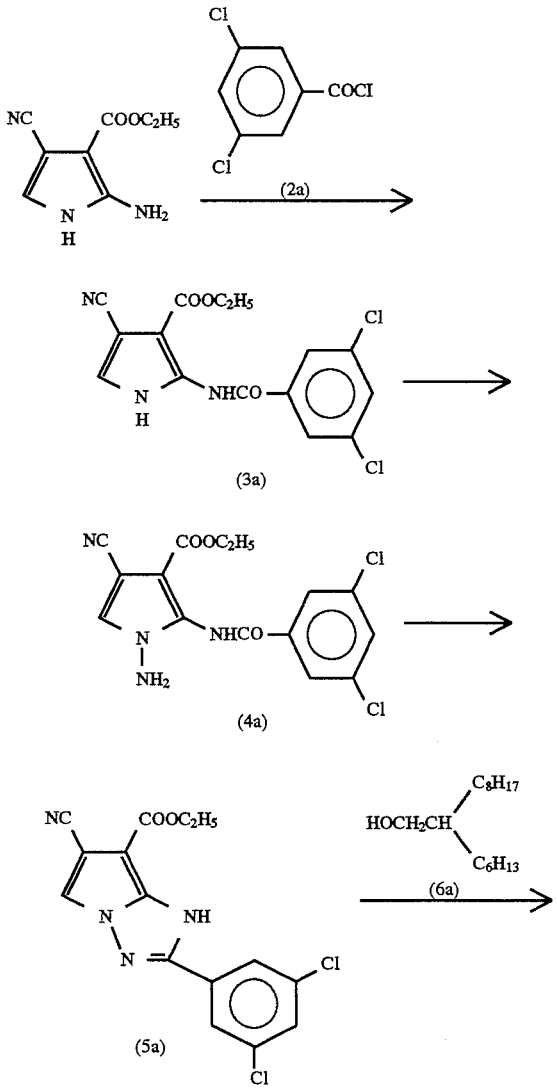

-continued

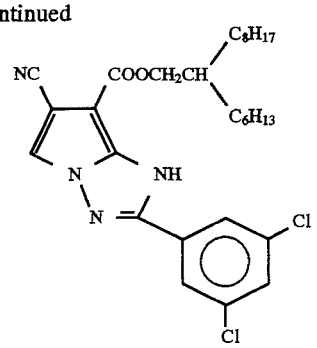

Exemplified Coupler (9)

Specifically, 3,5-dichlorobenzoyl chloride (2a) (83.2 g, 0.4 mol) was added to a solution of 2-amino-4-cyano-3-methoxycarbonylpyrrole (1a) (66.0 g, 0.4 mol) in dimethylacetamide (300 ml) at room temperature, and the resultant mixture was stirred for 30 minutes. Water was added to the resultant solution, and the solution was extracted twice with ethyl acetate. The organic layers were collected, washed with water and a saturated aqueous sodium chloride solution, and dried over anhydrous sodium sulfate. The solvent was distilled off under reduced pressure, and recrystallization was performed from acetonitrile (300 ml) to obtain a compound (3a) (113 g, 84%).

A powder of potassium hydroxide (252 g, 4.5 mol) was added to a solution of the compound (3a) (101.1 g, 0.3 mol) in dimethylformamide (200 ml) at room temperature, and the resultant mixture was stirred sufficiently. Hydroxylamine-o-sulfonic acid (237 g, 2.1 mol) was gradually added to the resultant solution under water cooling with enough care so as not to cause the temperature to rise abruptly, and the mixture was stirred for 30 minutes after the addition. An aqueous 0.1N hydrochloric acid solution was dropped to neutralize the resultant solution while checking pH test paper. The neutralized solution was extracted three times with ethyl acetate, and the organic layer was washed with water and a saturated aqueous sodium chloride solution and dried over anhydrous sodium sulfate. The solvent was distilled off under reduced pressure, and the residue was purified through a column chromatography (developing solvent; hexane:ethyl acetate=2:1), to obtain a compound (4a) (9.50 g. 9%).

Carbon tetrachloride (9 cc) was added to a solution of the compound (4a) (7.04 g, 20 mmol) in acetonitrile (30 ml) at room temperature, and subsequently triphenylphosphine (5.76 g, 22 mmol) was added to the resultant solution. The solution was refluxed under heating for eight hours. After the resultant solution was cooled, water was added to the solution, and the solution was extracted three times with ethyl acetate. The organic layer was washed with water and a saturated aqueous sodium chloride solution and dried over anhydrous sodium sulfate. The solvent was distilled off under reduced pressure, and the residue was purified through a silica gel column chromatography (developing solvent; hexane:ethyl acetate=4:1), to obtain a compound (5a) (1.13 g, 17%).

1.8 g of the compound (5a) and 12.4 g of a compound (6a) were dissolved in 2.0 ml of sulforane, and 1.8 g of titanium isopropoxide were added to the solution. The resultant solution was allowed to react at a temperature of 110° C. for 1.5 hours. Thereafter, ethyl acetate was added to the solution, and the resultant solution was washed with water. After the ethyl acetate layer was dried, distillation was performed. The residue was purified through a column chromatography to yield 1.6 g of the exemplified compound (9). The melting point was 97° to 98° C.

A high boiling point organic solvent represented by Formula (S) will be described below.

When $R_{11}$, $R_{12}$, or $R_{13}$ in Formula (S) is an alkyl group, this alkyl group may be either straight-chain or branched, may have an unsaturated bond on its chain, and may have a substituent. Examples of the substituent are a halogen atom, an aryl group, an alkoxy group, an aryloxy group, an alkoxycarbonyl group, a hydroxyl group, an acyloxy group, and an epoxy group. The substituent is not limited to these groups but further includes, e.g., moieties of phosphoric ester, phosphorous ester, and hypophosphorous ester and a phosphine oxide moiety, each of which is represented by Formula (S) from which $R_{11}$ is omitted.

When $R_{11}$, $R_{12}$, or $R_{13}$ is a cycloalkyl group or a group containing a cycloalkyl group, this cycloalkyl group is a 3- to 8-membered ring that may contain an unsaturated bond in the ring and may have a substituent or a crosslinking group. Examples of the substituent are a halogen atom, an alkyl group, a hydroxyl group, an acyl group, an aryl group, an alkoxy group, an aryloxy group, an alkoxycarbonyl group, an acyloxy group, and an epoxy group. Examples of the crosslinking group are methylene, ethylene, and isopropylidene.

When $R_{11}$, $R_{12}$, or $R_{13}$ is an aryl group or a group containing an aryl group, this aryl group may be substituted with a substituent, such as a halogen atom, an alkyl group, an alkoxy group, an aryloxy group, an alkoxycarbonyl group, and an acyloxy group.

A high boiling point organic solvent favorable in the present invention will be described below.

In Formula (S), each of $R_{11}$, $R_{12}$, and $R_{13}$ is an alkyl group having a total carbon atom number (to be abbreviated as a C number hereinafter) of 1 to 24 (more preferably a C number of 4 to 18), a cycloalkyl group having a C number of 5 to 24 (more preferably a C number of 6 to 18), or an aryl group having a C number of 6 to 24 (more preferably a C number of 6 to 18).

Examples of the substituted or unsubstituted alkyl group are n-butyl, 2-ethylhexyl, 3,3,5-trimethylhexyl, n-dodecyl, n-octadecyl, benzyl, oleyl, 2-chloroethyl, 2,3-dichloropropyl, 2-butoxyethyl, and 2-phenoxyethyl. Examples of the cycloalkyl group are cyclopentyl, cyclohexyl, 4-t-butylcyclohexyl, 4-methylcyclohexyl, and 2-cyclohexenyl. Examples of the aryl group are phenyl, cresyl, p-nonylphenyl, xylyl, cumenyl, p-methoxyphenyl, and p-methoxycarbonylphenyl.

In the present invention, at least one of k, m, and n is preferably 0.

In the present invention, a high boiling point organic solvent means a solvent having a boiling point of about 150° C. or more, preferably 170° C. or more at normal pressure. The form of the solvent at room temperature is not limited to a liquid. The solvent may take any other form, such as a low-melting crystal, an amorphous solid, or a paste. If the form of the solvent at room temperature is a crystal, its melting point is preferably 100° C. or less, and more preferably 80° C. or less.

These high boiling point organic solvents can be used either singly or in the form of a mixture of two or more high boiling point organic solvents. If two or more high boiling point organic solvents are to be used in the form of a mixture, at least one of these high boiling point organic solvents need only be that of the present invention, and so the other high-boiling organic solvents may be of any type. Examples of an organic solvent usable together with the solvent of the invention are esters of aromatic carboxylic acid such as phthalic acid and benzoic acid, esters of aliphatic carboxylic acid such as succinic acid and adipic acid, amide-based compounds, epoxy-based compounds, aniline-based compounds, and phenolic compounds. If the high boiling point organic solvent of the present invention is crystalline and its melting point is 80° C. or more, it is desirable that two or more types of high-boiling organic solvents be used in the form of a mixture.

When the high-boiling organic solvent of the present invention is to be used in the form of a mixture with other high-boiling organic solvents, the mixing ratio thereof is preferably 25 wt. % or more, and more preferably 50 wt. % or more if the former solvent is phosphoric ester. If the former solvent is phosphonic ester, phosphinic ester, or phosphine oxide, its mixing ratio is preferably 10 wt. % or more, and more preferably 20 wt. % or more.

The weight ratio of the high boiling point organic solvent of Formula (S), in which all of k, m and n is 1, to the coupler of Formula (Ia) is suitably 0.1 to 20, preferably 0.1 to 10, more preferably 1 to 10. Further, the weight ratio of the high boiling point organic solvent of Formula (S), in which at least one of k, m and n is 0, to the coupler of Formula (Ia) is suitably 0.1 to 20, preferably 0.1 to 10, more preferably 0.5 to 5.

Practical examples of a high boiling point organic solvent represented by Formula (S) are presented below, but the solvent is not limited to these examples.

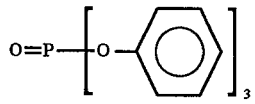
S-1

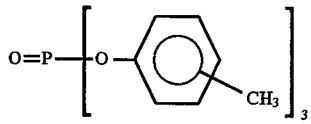
S-2

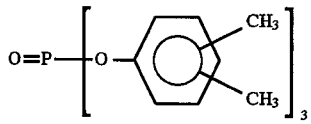
S-3

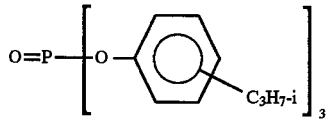
S-4

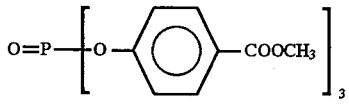
S-5

-continued

S-6

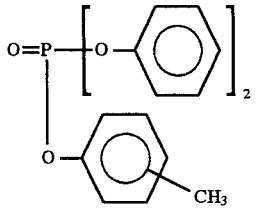

S-7

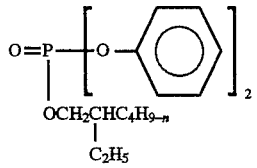

S-8 $O{=}P{\leftarrow}OC_4H_{9-n})_3$

S-9 $O{=}P{\leftarrow}OC_6H_{13-n})_3$

S-10 $O{=}P{\leftarrow}OCH_2\underset{\underset{C_2H_5}{|}}{C}HC_4H_{9-n})_3$

S-11 $O{=}P{\leftarrow}OCH_2\underset{\underset{CH_3}{|}}{C}HCH_2\overset{\overset{CH3}{|}}{C}CH_3)_3$ S-12 $O{=}S{\leftarrow}OC_{12}H_{25-n})_3$ S-13 $O{=}P{\leftarrow}OC_{16}H_{33-n})_3$ S-14 $O{=}P{\leftarrow}O(CH_2)_8CH{=}CHC_8H_{17-n}]_3$ S-15 $O{=}P{\leftarrow}OCH_2CH_2Cl)_3$ S-16 $O{=}P{\leftarrow}OCH_2CH_2OC_4H_{9-n})_3$ S-17 $O{=}P{\leftarrow}OCH_2\underset{\underset{Cl}{|}}{C}HCH_2Cl)_3$

S-18

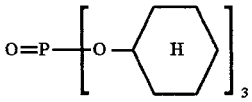

S-19

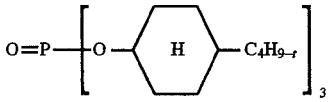

S-20

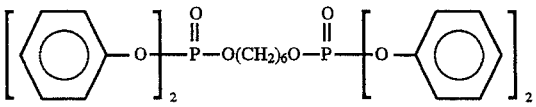

-continued

S-21

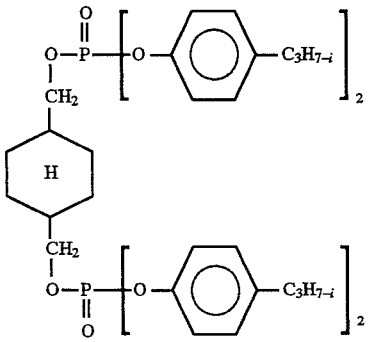

S-22 $(n\text{-}C_4H_9O)_2\overset{\overset{O}{\|}}{P}{-}O(CH_2)_6O{-}\overset{\overset{O}{\|}}{P}{\leftarrow}OC_4H_9\text{-}n)_2$

S-23

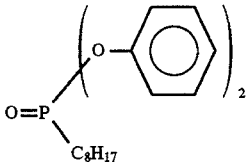

S-24

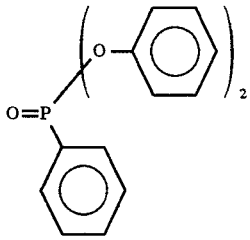

S-25

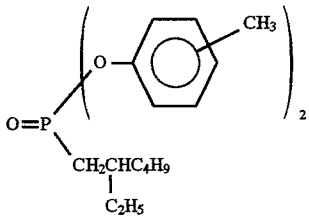

S-26

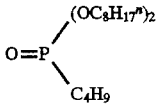

S-27

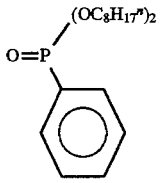

S-28

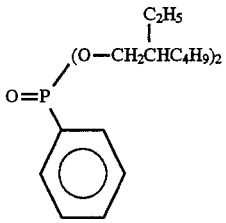

-continued
S-29
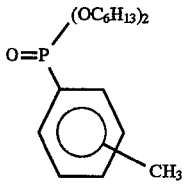
S-30
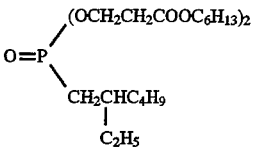
S-31
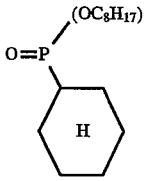
S-32
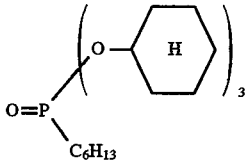
S-33
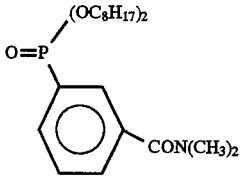
S-34
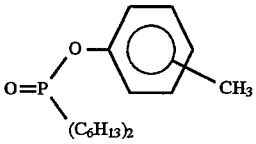
S-35
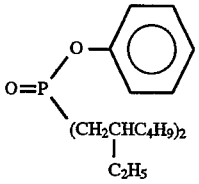
S-36
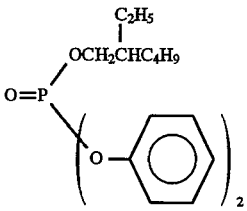
S-37
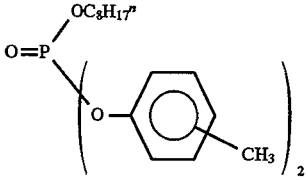
-continued
S-38
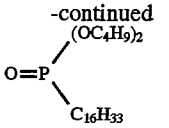
S-39
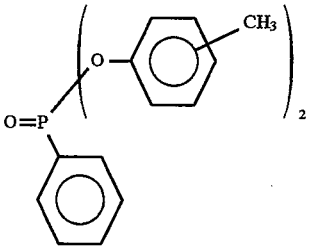
S-40
S-41
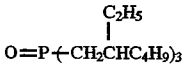
S-42
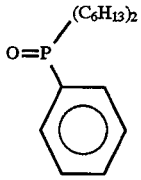
S-43
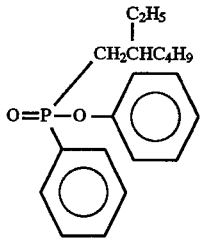
S-44
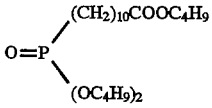
S-45
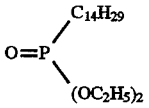
S-46
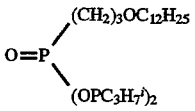
S-47
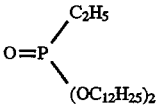
S-48
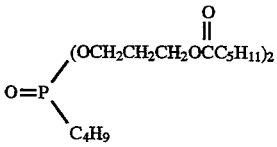
In the present invention, any conventionally known yellow dye-forming coupler can be used as a yellow dye-forming coupler (to be referred to as a yellow coupler hereinafter). Among these yellow couplers, a yellow coupler represented by Formula (Y) below is preferable:

Formula (Y)

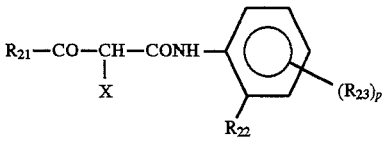

where $R_{21}$ represents a tertiary alkyl group or an aryl group, $R_{22}$ represents a hydrogen atom, a halogen atom (F, Cl, Br, or I; this will be the same in the following description of Formula (Y)), an alkoxy group, an aryloxy group, an alkyl group, or a dialkylamino group, $R_{23}$ represent a group substitutable on the benzene ring, X represents a hydrogen atom or a group (called a split-off group) that can split off through a coupling reaction with the oxidized form of an aromatic primary amine developing agent, and p represents an integer from 0 to 4. If p is the plural number, a plurality of $R_{23}$'s may be the same or different.

Examples of $R_{23}$ are a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an arylsulfonyl group, a ureido group, a sulfamoylamino group, an alkoxycarbonylamino group, a nitro group, a heterocyclic group, a cyano group, an acyl group, an acyloxy group, an alkylsulfonyloxy group, and an arylsulfonyloxy group. Examples of the split-off group are a heterocyclic group that bonds to a coupling active position through a nitrogen atom, an aryloxy group, an arylthio group, an acyloxy group, an alkylsulfonyloxy group, a heterocyclic oxy group, and a halogen atom.

When $R_{21}$ is a tertiary alkyl group, this tertiary alkyl group may include a cyclic structure, such as cyclopropyl, cyclobutyl, cyclopentyl, and cyclohexyl.

In Formula (Y), it is preferable that $R_{21}$ be a t-butyl group, a 1-alkylcyclopropyl group, or a 1-alkylcyclopentyl group, $R_{22}$ be a halogen atom, an alkyl group (including trifluoromethyl), an alkoxy group, or a phenoxy group, $R_{23}$ be a halogen atom, an alkoxy group, an alkoxycarbonyl group, a carbonamide group, a sulfonamide group, a carbamoyl group, a sulfonyl group, or a sulfamoyl group (including an acylsulfamoyl group), X be an aryloxy group or a 5- to 7-membered heterocyclic group that bonds to a coupling active position through a nitrogen atom and may further contain N, S, O, or P, and p be an integer of 0 to 2.

In Formula (Y), when $R_{21}$ is a 1-alkylcyclopropyl group or a 1-alkylcyclopentyl group, the alkyl moiety is preferably an alkyl having 1 to 18 carbon atoms, more preferably a straight-chain alkyl group having 1 to 4 carbon atoms, and most preferably an ethyl group.

A coupler represented by Formula (Y) may be a dimmer or a higher-order polymer, a homopolymer, or a copolymer including a non-color forming polymer, that bonds through a divalent or higher-valence group in the substituent $R_{21}$, X, or the group indicated below:

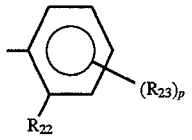

Practical examples of a coupler represented by Formula (Y) are presented below.

(Y-1)

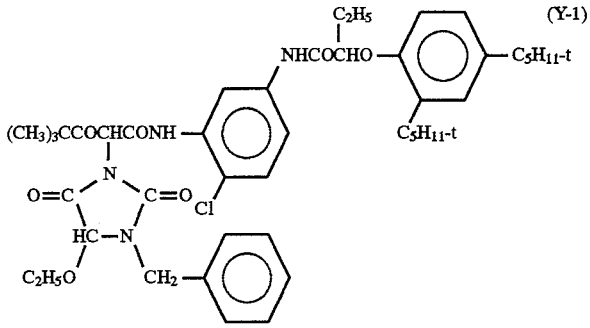

(Y-2)

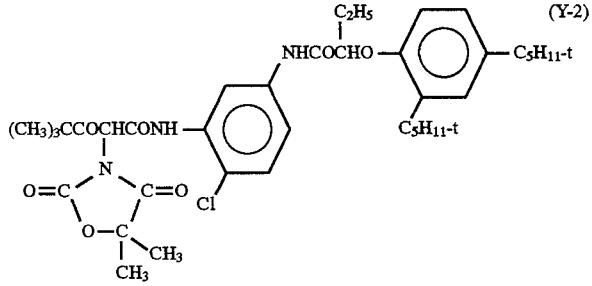

(Y-3)

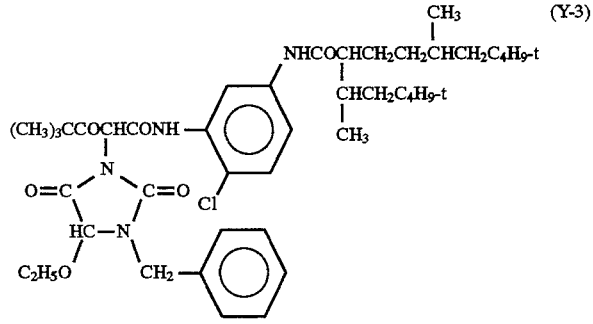

(Y-4)

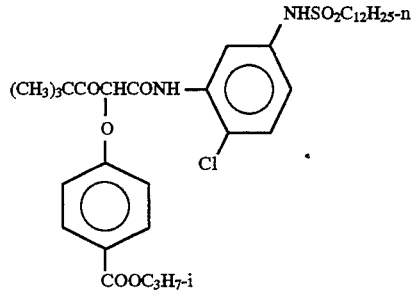

(Y-5)

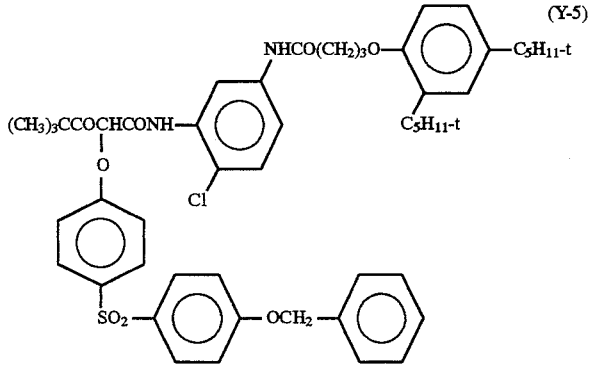

-continued
(Y-6)
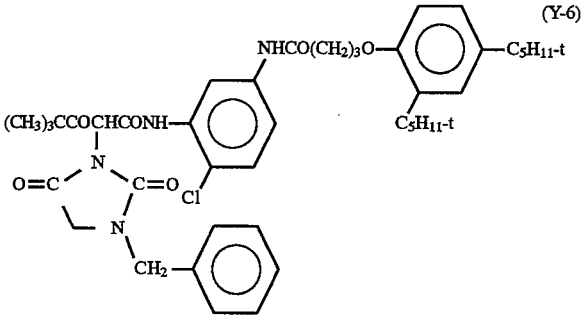
(Y-7)
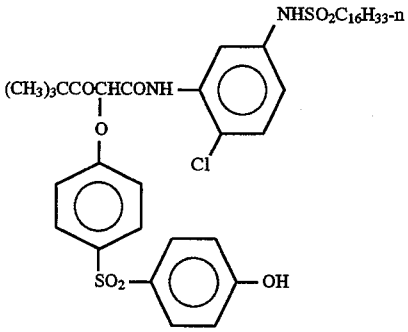
(Y-8)
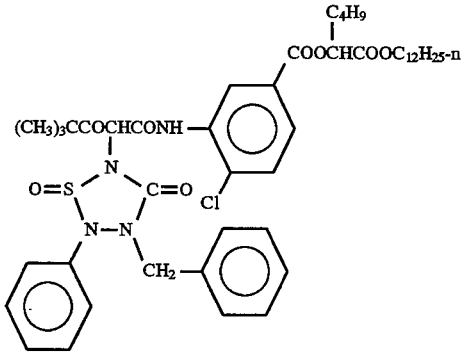
(Y-9)
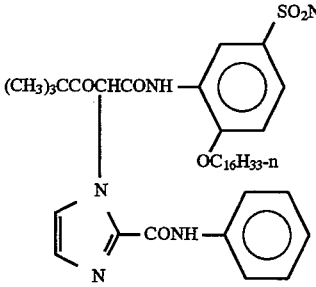
(Y-10)
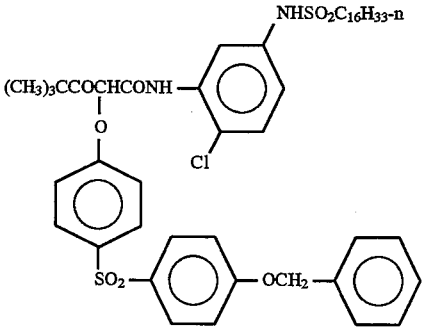
-continued
(Y-11)
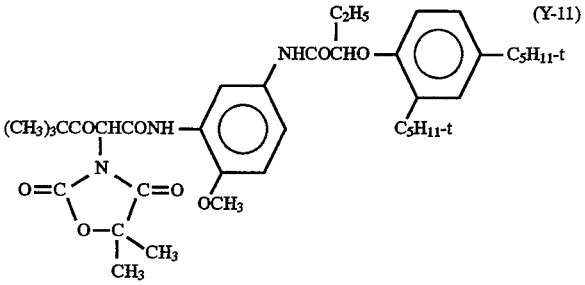
(Y-12)
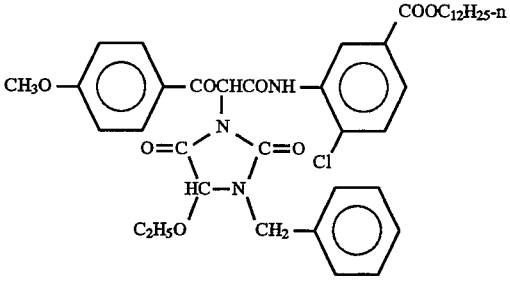
(Y-13)
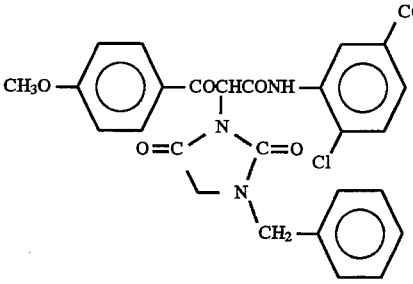
(Y-14)
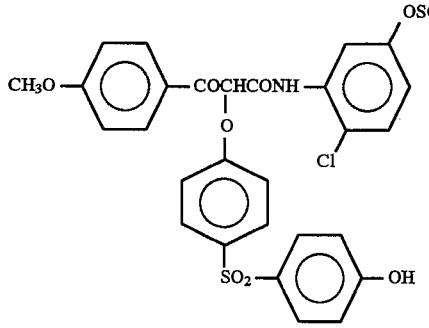
(Y-15)
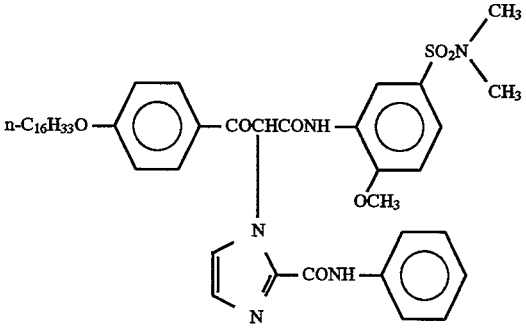

-continued (Y-16)

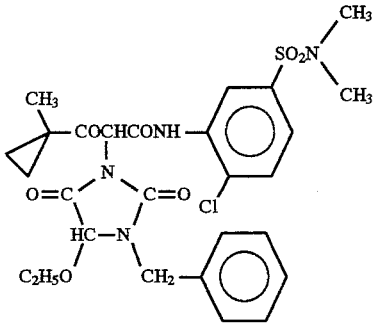

(Y-17)

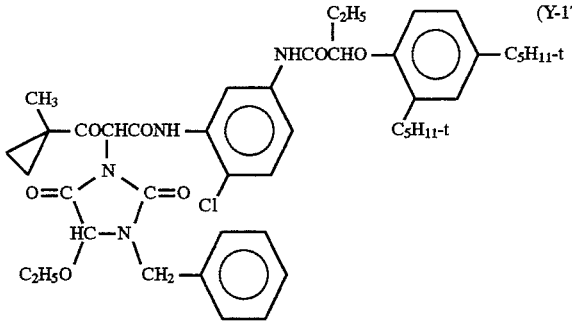

(Y-18)

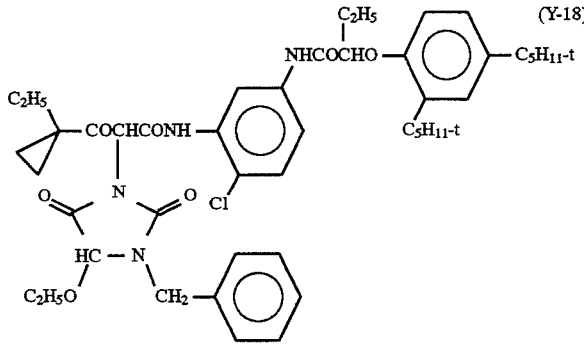

(Y-19)

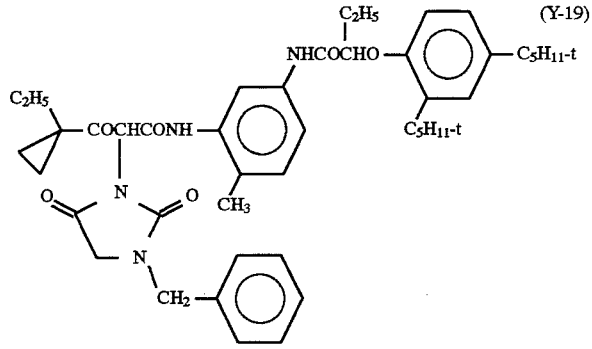

-continued (Y-20)

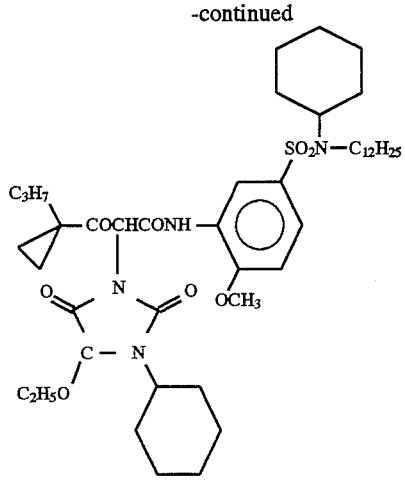

(Y-21)

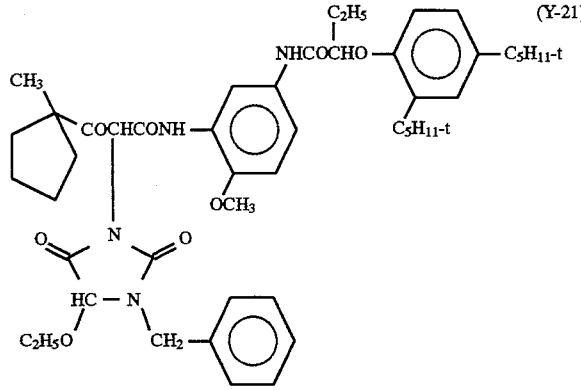

Examples of the yellow coupler, other than those described above, that can be used in the present invention, and/or methods of synthesizing these yellow couplers are described in, e.g., U.S. Pat. Nos. 3,227,554, 3,408,194, 3,894,875, 3,933,501, 3,973,968, 4,022,620, 4,057,432, 4,115,121, 4,203,768, 4,248,961, 4,266,019, 4,314,023, 4,327,175, 4,401,752, 4,404,274, 4,420,556, 4,711,837, and 4,729,944, European Patents 30,747A, 284,081A, 296, 793A, and 313,308A, West German Patent 3,107,173C, JP-A-58-42044, JP-A-59-174839, JP-A-62-276547, JP-A-63-123047, and JP-A-4-116643.

When the cyan coupler of the present invention is to be applied to a silver halide color light-sensitive material, at least one layer containing the coupler of the present invention need only be formed on a support, and the layer containing the coupler of the present invention can be a hydrophilic colloid layer on the support. A common color light-sensitive material can be constituted by coating at least one of each of blue-, green-, and red-sensitive silver halide emulsion layers in this order on a support, but the order of these layers may be different from this one. In addition, an infrared-sensitive silver halide emulsion layer can be used in place of at least one of the above light-sensitive emulsion layers. Color reproduction according to a subtractive color process can be performed by allowing these light-sensitive emulsion layers to contain silver halide emulsions having sensitivities in their respective wavelength regions and color couplers which form dyes bearing relationships of complementary colors to light components to be sensed by these emulsions. Note that the arrangement may be altered such that a light-sensitive emulsion layer and the hue of a color coupler do not have the above relation.

When the coupler of the present invention is to be applied to a light-sensitive material, the coupler is particularly preferably used in a red-sensitive silver halide emulsion layer.

The addition amount of each of the cyan, magenta and yellow couplers of the present invention to a light-sensitive material is generally $1\times10^{-3}$ to 1 mol, preferably $2\times10^{-3}$ to $5\times10^{-1}$ mol per mol of silver halide.

Examples of a silver halide usable in the present invention are silver chloride, silver bromide, silver chlorobromide, silver bromochloroiodide, and silver bromolodide. In order to realize rapid processing, however, it is preferable to use a silver bromoiodide or silver chloride emulsion which does not essentially contain silver iodide and has a silver chloride content of 90 mol % or more, more preferably 95% or more, and most preferably 98% or more, which is hereinafter referred to as a silver chloride-rich emulsion.

In the light-sensitive material according to the present invention, in order to improve, e.g., the sharpness of an image, a dye (particularly an oxonole-based dye) that can be discolored by processing, described in EP0,337,490A2, pages 27 to 76, is preferably added to the hydrophilic colloid layer such that an optical reflection density at 680 nm in the light-sensitive material is 0.70 or more. It is also preferable to add 12% by weight or more (more preferably 14% by weight or more) of titanium oxide that is surface-treated with, for example, dihydric to tetrahydric alcohols (e.g., trimethylolethane) to a water-resistant resin layer of the support.

A high boiling point organic solvent for photographic additives, such as magenta and yellow couplers, that can be used in the present invention may be any compound which has a melting point of 100° C. or less and a boiling point of 140° C. or more, is immiscible with water, and is a good solvent for couplers. The melting point of the high boiling point organic solvent is preferably 80° C. or less. The boiling point of the high boiling point organic solvent is preferably 160° C. or more, and more preferably 170° C. or more.

The details of these high boiling point organic solvents are described in JP-A-62-215272, page 137, lower right column to page 144, upper right column.

A cyan, magenta, or yellow coupler can be impregnated in a loadable latex polymer (such as described in U.S. Pat. No. 4,203,716) or dissolved in a polymer, which is insoluble in water and soluble in an organic solvent, in the presence or absence of the above high boiling point organic solvent, and can be emulsion-dispersed in a hydrophilic aqueous colloid solution.

It is preferable to use homopolymers or copolymers described in U.S. Pat. No. 4,857,449, the 7th to 15th columns, and WO88/00723, pages 12 to 30. The use of a methacrylate-based or acrylamide-based polymer, particularly an acrylamide-based polymer is more preferable in terms of stabilization of dye images.

The light-sensitive material according to the present invention preferably contains, in addition to the couplers, dye image stability improving compounds as described in EP0,277,589A2. A combination of these compounds with a pyrazoloazole coupler or the pyrrolotriazole coupler of the present invention is particularly preferable.

That is, the use of one or both of a compound (F) which chemically bonds to an aromatic amine developing agent remaining after color development and yields a compound that is chemically inert and essentially colorless and a compound (G) which chemically bonds to the oxidized form of an aromatic amine color developing agent remaining after color development and yields a compound that is chemically inert and essentially colorless is preferable in preventing occurrence of stains or other side effects due to color forming dyes produced by a reaction between the color developing agent or its oxidized form remaining in films during storage of the material after the processing.

In order to prevent various fungi and bacteria which multiply in the hydrophilic colloid layer to impair the image quality, mildewproofing agents as described in JP-A-63-271247 are preferably added to the light-sensitive material of the present invention.

A support for use in the light-sensitive material according to the present invention may be a white polyester-based support for a display purpose or a support in which a layer containing a white pigment is formed on the side having silver halide emulsion layers. In addition, in order to improve the sharpness, an anti-halation layer is preferably formed on the side having silver halide emulsion layers or the back side of a support. It is also preferable to set the transmission density of a support to 0.35 to 0.8 so that a display can be monitored with either reflected light or transmitted light.

The light-sensitive material according to the present invention can be exposed by either visible light or infrared light. An exposure method can be either low-intensity exposure or high-intensity, short-time exposure. In the present invention, however, an exposure scheme in which an exposure time per pixel is shorter than $10^{-3}$ second is preferable, and a laser scanning exposure scheme with an exposure time shorter than $10^{-4}$ second is more preferable.

In performing exposure, it is preferable to use a band stop filter described in U.S. Pat. No. 4,880,726. This filter removes light color mixing to significantly improve color reproducibility.

Although the exposed light-sensitive material can be subjected to conventional color development, it is preferable to perform bleach-fixing after the color development for the purpose of rapid processing. Especially when the silver chloride-rich emulsion described above is to be used, the pH of a bleach-fixing solution is set to preferably about 6.5 or less, and more preferably about 6 or less for the purpose of accelerating desilvering.

As the silver halide emulsions, the other materials (e.g., additives), and photographic constituting layers (e.g., layer arrangements) to be applied to the light-sensitive material according to the present invention, and as methods and additives to be applied to process this light-sensitive material, those described in patent specifications presented below, particularly EP0,355,660A2 (JP-A-2-139544) can be preferably used.

TABLE 1

| Photographic constituting elements | JP-A-62-215272 | JP-A-2-33144 | EPO,355,660A2 |
|---|---|---|---|
| Silver halide emulsions | page 10, upper right column, line 6 to page 12, lower left column, line 5 and page 12, lower right column, 4 from the bottom to page 13, upper left column, line 17 | page 28, upper right column, line 16 to page 29, lower right column, line 11 and page 30, lines 2 to 5 | page 45, line 53 to page 47, line 3 and page 47, lines 20 to 22 |
| Silver halide solvents | page 12, lower left column, lines 6 to 14 and page 13, upper left column, line 3 from the bottom to page 18, lower left column, the last line | — | — |
| Chemical sensitizer | page 12, lower left column, line 3 from the bottom to lower right column, line 5 from the bottom and page 18, lower right column, line 1 to page 22, upper right column, line 9 from the bottom | page 29, lower right column, lines 12 to the last line | page 47, lines 4 to 9 |
| Spectral sensitizers (Spectral sensitization methods) | page 22, upper right column, line 8 from the bottom to page 38, the last line | page 30, upper left column, lines 1 to 13 | page 47, lines 4 to 9 |
| Emulsion stabilizers | page 39, upper left column, line 1 to page 72, upper right column, the last line | page 30, upper left column, line 14 to upper right column, line 1 | page 47, lines 16 to 19 |
| Development accelerators | page 72, lower left column, line 1 to page 91, upper right column, line 3 | — | — |

TABLE 2

| Photographic constituting elements | JP-A-62-215272 | JP-A-2-33144 | EPO,355,660A2 |
|---|---|---|---|
| Color couplers (cyan, magenta, and yellow couplers) | page 91, upper right column, line 4 to page 121, upper left column, line 6 | page 3, upper right column, line 14 to page 18, upper left column, the last line and page 30, upper right column, line 6 to page 35, lower right column, line 11 | page 4, lines 15 to 27, page 5, line 30 to page 28, the last line, page 45, lines 29 to 31, and page 47, line 23 to page 63, line 50 |
| Color boosters | page 121, lower left column, line 7 to page 125, upper right column, line 1 | — | — |
| Ultraviolet absorbents | page 125, upper right column, line 2 to page 127, lower left column, the last line | page 37, lower right column, line 14 to page 38, upper left column, line 11 | page 65, lines 22 to 31 |
| Color mixing inhibitors (image stabilizers) | page 127, lower right column, line 1 to page 137, lower left column, line 8 | page 36, upper right column, line 12 to page 37, upper left column, line 19 | page 4, line 30 to page 5, line 23, page 29, line 1 to page 45, line 25, page 45, lines 33 to 40, and page 65, lines 2 to 21 |
| High boiling and/or low boiling point organic solvents | page 137, lower left column, line 9 to page 144, upper right column, the last line | page 35, lower right column, line 14 to page 36, upper left column, line 4 from the bottom | page 64, lines 1 to 51 |
| Methods of | page 144, lower left | page 27, lower right | page 63, line 51 to page |

TABLE 2-continued

| Photographic constituting elements | JP-A-62-215272 | JP-A-2-33144 | EPO,355,660A2 |
|---|---|---|---|
| dispersing photographic additives | column, line 1 to page 146, upper right column, line 7 | column, line 10 to page 28, upper left column, the last line and page 35, lower right column, line 12 to page 36 upper right column, line 7 | 64, line 56 |

TABLE 3

| Photographic constituting elements | JP-A-62-215272 | JP-A-2-33144 | EPO,355,660A2 |
|---|---|---|---|
| Film hardeners | page 146, upper right column, line 8 to page 155, lower left column, line 4 | — | — |
| Developing agent precursors | page 155, lower left column, line 5 to page 155, lower right column, line 2 | — | — |
| Development inhibitor releasing compounds | page 155, lower right column, lines 3 to 9 | — | — |
| Supports | page 155, lower right column, line 19 to page 156, upper left column, line 14 | page 38, upper right column, line 18 to page 39, upper left column, line 3 | page 66, line 29 to page 67, line 13 |
| Arrange-ments of light-sensitive layers | page 156, upper left column, line 15 to page 156, lower right column, line 14 | page 28, upper right column, line 1 to 15 | page 45, lines 41 to 52 |
| Dyes | page 156, lower right column, line 15 to page 184, lower right column, the last line | page 38, upper left column, line 12 to upper right column, line 7 | page 66, lines 18 to 22 |
| Color mixing inhibitors | page 185, upper left column, line 1 to page 188, lower right column, line 3 | page 36, upper right column, lines 8 to 11 | page 64, line 57 to page 65, line 1 |
| Gradation regulators | page 188, lower right column, lines 4 to 8 | — | — |

TABLE 4

| Photographic constituting elements | JP-A-62-215272 | JP-A-2-33144 | EPO,355,660A2 |
|---|---|---|---|
| Stain inhibitors | page 188, lower right column, line 9 to page 193, lower right column, line 10 | page 37, upper left column, the last line to lower right column, line 13 | page 65, line 32 to page 66, line 17 |
| Surfactants | page 201, lower left column, line 1 to page 210, upper right column, the last line | page 18, upper right column, line 1 to page 24, lower right column, the last line and page 27, lower left column, line 10 from the bottom to lower right column, line 9 | — |
| Fluorine-containing compounds (as, e.g., antistatic agents, | page 210, lower left column, line 1 to page 222, lower left column, line 5 | page 25, upper left column, lines 1 to page 27, upper right column, line 9 | — |

TABLE 4-continued

| Photographic constituting elements | JP-A-62-215272 | JP-A-2-33144 | EPO,355,660A2 |
|---|---|---|---|
| coating aids, lubricants, and adhesion inhibitors) | | | |
| Binders (hydrophilic colloid) | page 222, lower left column, line 6 to page 225, upper left column, the last line | page 38, upper right column, lines 8 to 18 | page 66, lines 23 to 28 |
| Thickening agents | page 225, upper right column, line 1 to page 227, upper right column, line 2 | | |
| Antistatic agents | page 227, upper right column, line 3 to page 230, upper left column, line 1 | | |

TABLE 5

| Photographic constituting elements | JP-A-62-215272 | JP-A-2-33144 | EPO,355,660A2 |
|---|---|---|---|
| Polymer latexes | page 230, upper left column, line 2 to page 239, the last line | — | — |
| Matting agents | page 240, upper left column, line 1 to page 240, upper right column, the last line | | |
| Photographic processing methods (e.g., processing steps and additives) | page 3, upper right column, line 7 to page 10, upper right column, line 5 | page 39, upper left column, line 4 to page 42, upper left column, the last line | page 67, line 14 to page 69, line 28 |

Note:
Portions cited from JP-A-62-215272 also include the contents amended by the amendment dated March 16, 1987 appended to the end of JP-A-62-215272.

In addition, the cyan coupler of the present invention can be used together with a diphenylimidazole-based cyan coupler described in JP-A-2-33144, a 3-hydroxypyridine-based cyan coupler (particularly a coupler (42), which is a 2-equivalent coupler formed by allowing a 4-equivalent coupler to have a chlorine split-off group, and couplers (6) and (9) enumerated as practical examples are most preferable) described in EP0,333,185A2 or a cyclic active methylene-based cyan coupler (particularly couplers 3, 8, and 34 enumerated as practical examples are most preferable) described in JP-A-64-32260.

As a method of processing a silver halide color light-sensitive material using a silver chloride-rich emulsion with a silver chloride content of 90 mol % or more, a method described in JP-A-2-207250, page 27, upper left column to page 34, upper right column can be applied preferably.

The present invention will be described in greater detail below by way of its examples, but the present invention is not limited to these examples.

EXAMPLE 1

A monochromic light-sensitive material for evaluation having the layer arrangement presented below was formed on a subbed triacetyl cellulose support (Sample 102).

(Preparation of Emulsion Layer Coating Solution)

1.85 mmol of a coupler (ExC-1 given below), 10 cc of ethyl acetate, and RS-1 (solvent) shown below in a weight equal to that of the coupler were dissolved, and the resultant solution was emulsion-dispersed in 33 g of an aqueous 14% gelatin solution containing 3 cc of a 10% sodium dodecylbenzenesulfonate solution. Separately, a silver chlorobromide emulsion (silver bromide 70 mol %) was sulfur-sensitized, and the resultant emulsion was mixed with in the above emulsion and dissolved to prepare a coating solution having the following composition. Note that sodium 1-oxy-3,5-dichloro-s-triazinate was used as a film hardener.

(Layer Arrangement)

The layer arrangement of the sample used in this experiment are presented below. (The number represents the coating amount per $m^2$.)

(Support)

Triacetylcellulose support (Emulsion layer)

| | |
|---|---|
| Silver chlorobromide emulsion (described above) | 3.0 mmol |
| Coupler (ExC-1) | 1.0 mmol |
| Solvent (RS-1) | (the same weight as the coupler coating weight) |
| Gelatin | 5.2 g |
| (Protective layer) | |
| Gelatin | 1.3 g |
| Acryl-modified copolymer of polyvinyl alcohol (modification degree 17%) | 0.17 g |
| Liquid paraffin | 0.03 g |

After the above light-sensitive material was imagewise exposed by using an optical wedge, processing was performed through the following steps.

(Processing)

| Step | Temperature | Time |
|---|---|---|
| Color development | 33° C. | 2 min. |
| Bleach-fixing | 33° C. | 1.5 min. |
| Washing | 33° C. | 3 min. |

(Compositions of processing solutions)

[Color developing solution]

| | |
|---|---|
| Distilled water | 800 ml |
| Triethanolamine | 8.1 g |
| Diethylhydroxylamine | 4.2 g |
| Potassium bromide | 0.6 g |
| Sodium bicarbonate | 3.9 g |
| Sodium sulfite | 0.13 g |
| N-ethyl-N-(β-methanesulfonamidoethyl)-3-methyl-4-aminoaniline sulfate | 5.0 g |
| Potassium carbonate | 18.7 g |
| Water to make | 1,000 ml |
| pH | 10.25 |

[Bleach-fixing solution]

| | |
|---|---|
| Distilled water | 400 ml |
| Ammonium thiosulfate (700 g/l) | 150 ml |
| Sodium sulfate | 18.0 g |
| Ammonium ethylenediamine-tetraacetate(III) | 55.0 g |
| Sodium ethylenediamine-tetraacetate | 5.0 g |
| Water to make | 1,000 ml |
| pH | 6.70 |

Samples 101 and 103 to 190 were made following the same procedures as for the sample 102 except that the cyan coupler and the high boiling point organic solvent of the sample 102 were replaced as listed in Table A. Note that when the cyan coupler was the pyrroloazole-based cyan coupler of the present invention, the coating amount of the coupler was set to 0.5 mmol/m$^2$. The structures of the couplers and the high boiling point organic solvents used as comparative compounds in this example are shown below.

Comparative couplers

ExC-1

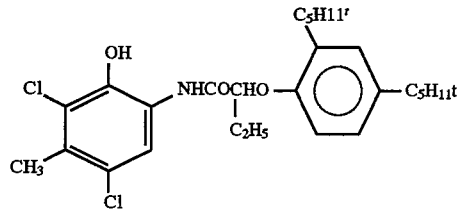

ExC-2

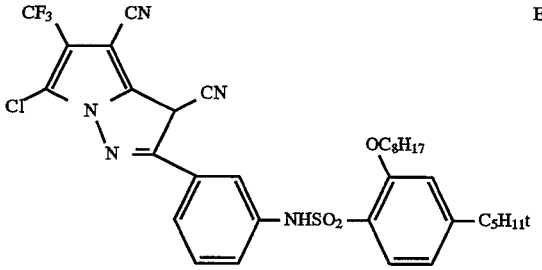

ExC-3

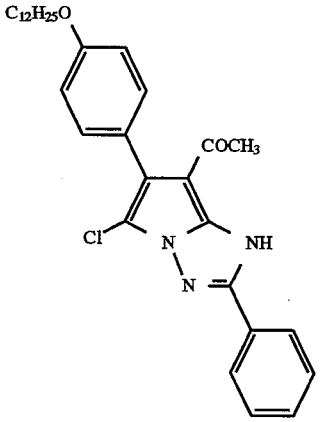

(Compound described in JP-A-62-279340)

Comparative high boiling point organic solvents

RS-1

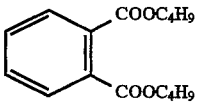

RS-2

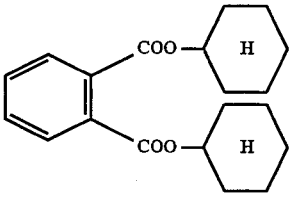

RS-3

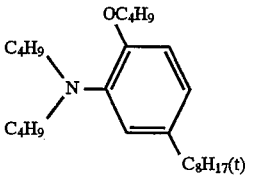

After the processing, density measurement was performed for each sample by using red, green, and blue filters, forming sensitometry curves. First, a maximum cyan density Dmax was read from the sensitometry curve measured by using the red filter. Subsequently, to evaluate the yellow and magenta components in the cyan dye, a blue optical density (density measured by using the blue filter) B and a green optical density (density measured by using the green filter) G were obtained at an exposure amount at which red optical density=1.0 was given. The yellow and magenta components were calculated from the following equations:

Yellow component $Y=B/R$

Magenta component $M=G/R$

The smaller the Y and M values, the smaller the amounts of undesirable yellow and magenta components in the cyan dye, indicating a better hue.

The obtained results are also summarized in Table A.

TABLE A

| Sample | | High boiling point organic solvent | | | Hue | | |
|---|---|---|---|---|---|---|---|
| No. | Coupler | Type | c/o ratio | $D_{max}$ | M | Y | Remarks |
| 101 | ExC-1 | RS - 1 | 0.5 | 1.73 | 0.168 | 0.082 | Comparative example |
| 102 | " | " | 1.0 | 1.78 | 0.165 | 0.082 | " |
| 103 | " | " | 2.0 | 1.82 | 0.161 | 0.082 | " |
| 104 | " | " | 4.0 | 1.67 | 0.158 | 0.083 | " |
| 105 | " | RS - 1 | 1.0 | 1.71 | 0.162 | 0.082 | " |
| | | SR - 2 | 1.0 | | | | |
| 106 | " | RS - 3 | 2.0 | 1.64 | 0.160 | 0.081 | " |
| 107 | " | S - 2 | 1.0 | 1.82 | 0.161 | 0.080 | " |
| 108 | " | S - 2 | 2.0 | 1.87 | 0.156 | 0.082 | " |
| 109 | " | S - 2 | 4.0 | 1.63 | 0.152 | 0.083 | " |
| 110 | " | S - 25 | 2.0 | 1.81 | 0.159 | 0.081 | " |
| 111 | " | S - 34 | 2.0 | 1.76 | 0.158 | 0.080 | " |
| 112 | " | S - 40 | 2.0 | 1.71 | 0.161 | 0.081 | " |
| 113 | ExC-2 | RS- 1 | 2.0 | 1.89 | 0.173 | 0.063 | " |
| 114 | " | S - 2 | 2.0 | 1.94 | 0.168 | 0.061 | " |
| 115 | " | S - 25 | 2.0 | 1.83 | 0.153 | 0.062 | " |
| 116 | 21 | SR- 1 | 0.5 | 1.92 | 0.185 | 0.039 | " |
| 117 | " | " | 1.0 | 2.01 | 0.177 | 0.039 | " |
| 118 | " | " | 2.0 | 2.05 | 0.172 | 0.038 | " |
| 119 | " | " | 4.0 | 2.07 | 0.168 | 0.039 | " |
| 120 | " | SR - 1 | 1.0 | 1.98 | 0.818 | 0.040 | " |
| | | SR - 2 | 1.0 | | | | |
| 121 | " | RS - 3 | 2.0 | 1.95 | 0.187 | 0.038 | " |
| 122 | " | S - 2 | 0.5 | 1.99 | 0.154 | 0.040 | Present invention |
| 123 | " | " | 1.0 | 2.08 | 0.147 | 0.038 | " |
| 124 | " | " | 2.0 | 2.11 | 0.131 | 0.037 | " |
| 125 | " | " | 4.0 | 2.10 | 0.114 | 0.036 | " |
| 126 | " | S - 25 | 0.5 | 2.04 | 0.139 | 0.040 | " |
| 127 | " | " | 1.0 | 2.07 | 0.128 | 0.039 | " |
| 128 | 21 | S - 25 | 2.0 | 2.09 | 0.117 | 0.040 | " |
| 129 | " | " | 4.0 | 2.10 | 0.105 | 0.041 | " |
| 130 | " | S - 34 | 0.5 | 2.01 | 0.142 | 0.040 | " |
| 131 | " | " | 1.0 | 2.06 | 0.130 | 0.041 | " |
| 132 | " | " | 2.0 | 2.06 | 0.119 | 0.042 | " |
| 133 | " | " | 4.0 | 2.07 | 0.108 | 0.044 | " |
| 134 | " | S - 40 | 0.5 | 1.90 | 0.102 | 0.045 | " |
| 135 | " | " | 1.0 | 1.96 | 0.095 | 0.044 | " |
| 136 | " | " | 2.0 | 2.01 | 0.091 | 0.043 | " |
| 137 | " | " | 4.0 | 1.98 | 0.090 | 0.045 | " |
| 138 | " | S - 9 | 2.0 | 2.11 | 0.133 | 0.037 | " |
| 139 | " | S - 20 | 2.0 | 2.08 | 0.135 | 0.038 | " |
| 140 | " | S - 27 | 2.0 | 2.07 | 0.120 | 0.039 | " |
| 141 | " | S - 35 | 2.0 | 2.09 | 0.123 | 0.042 | " |
| 142 | " | S - 41 | 2.0 | 2.06 | 0.094 | 0.044 | " |
| 143 | " | S - 2 | 1.5 | 2.10 | 0.125 | 0.038 | " |
| | " | S - 25 | 0.5 | | | | |
| 144 | " | " | 1.0 | 2.08 | 0.121 | 0.039 | " |
| | " | " | 1.0 | | | | |
| 145 | " | " | 2.0 | 2.12 | 0.110 | 0.038 | " |
| | " | " | 1.0 | | | | |
| 146 | " | S - 2 | 1.75 | 2.09 | 0.121 | 0.039 | " |
| | " | S - 40 | 0.25 | | | | |
| 147 | " | " | 1.5 | 2.07 | 0.108 | 0.041 | " |
| | " | " | 0.5 | | | | |
| 148 | " | " | 1.0 | 2.03 | 0.101 | 0.042 | " |
| | " | " | 1.0 | | | | |
| 149 | " | " | 0.7 | 2.00 | 0.112 | 0.044 | " |
| | " | " | 0.3 | | | | |
| 150 | " | S - 2 | 1.0 | 2.06 | 0.126 | 0.042 | " |
| | | S - 34 | 1.0 | | | | |
| 151 | 14 | RS - 1 | 0.5 | 1.78 | 0.167 | 0.047 | Comparative example |
| 152 | " | " | 1.0 | 1.95 | 0.160 | 0.044 | " |
| 153 | " | " | 2.0 | 2.01 | 0.158 | 0.045 | " |
| 154 | " | " | 4.0 | 2.00 | 0.157 | 0.045 | " |

TABLE A-continued

| Sample | | High boiling point organic solvent | | | Hue | | |
|---|---|---|---|---|---|---|---|
| No. | Coupler | Type | c/o ratio | $D_{max}$ | M | Y | Remarks |
| 155 | " | S - 2 | 0.5 | 1.86 | 0.149 | 0.046 | Present invention |
| 156 | " | " | 1.0 | 1.99 | 0.143 | 0.043 | " |
| 157 | " | " | 2.0 | 2.02 | 0.127 | 0.043 | " |
| 158 | " | " | 4.0 | 2.01 | 0.112 | 0.043 | " |
| 159 | " | S - 25 | 0.5 | 1.95 | 0.133 | 0.047 | " |
| 160 | " | " | 1.0 | 1.98 | 0.125 | 0.046 | " |
| 161 | " | " | 2.0 | 2.03 | 0.112 | 0.046 | " |
| 162 | " | " | 4.0 | 2.04 | 0.103 | 0.046 | " |
| 163 | " | S - 34 | 2.0 | 2.00 | 0.113 | 0.048 | " |
| 164 | " | S - 40 | 2.0 | 1.98 | 0.092 | 0.051 | " |
| 165 | " | S - 2 | 1.5 | 2.05 | 0.120 | 0.042 | " |
| | | S - 25 | 0.5 | | | | |
| 166 | " | " | 1.0 | 2.02 | 0.116 | 0.045 | " |
| | | " | 1.0 | | | | |
| 167 | " | S - 2 | 1.5 | 1.99 | 0.107 | 0.045 | " |
| | | S - 40 | 0.5 | | | | |
| 168 | " | " | 0.7 | 1.95 | 0.111 | 0.048 | " |
| | | " | 0.3 | | | | |
| 169 | 12 | RS - 1 | 2.0 | 1.87 | 0.156 | 0.047 | Comparative example |
| 170 | " | S - 4 | 2.0 | 1.94 | 0.132 | 0.046 | Present invention |
| 171 | " | S - 28 | 2.0 | 1.91 | 0.118 | 0.046 | " |
| 172 | " | S - 37 | 2.0 | 1.89 | 0.096 | 0.047 | " |
| 173 | " | RS - 1 | 2.0 | 1.92 | 0.151 | 0.043 | Comparative example |
| 174 | 20 | S - 4 | 2.0 | 1.95 | 0.128 | 0.041 | Present invention |
| 175 | " | S - 28 | 2.0 | 1.94 | 0.106 | 0.041 | " |
| 176 | " | S - 37 | 2.0 | 1.92 | 0.097 | 0.044 | " |
| 177 | 18 | RS - 1 | 2.0 | 1.98 | 0.149 | 0.039 | Comparative example |
| 178 | " | S - 4 | 2.0 | 2.04 | 0.137 | 0.037 | Present invention |
| 179 | " | S - 28 | 2.0 | 2.00 | 0.114 | 0.038 | " |
| 180 | | S - 37 | 2.0 | 2.02 | 0.101 | 0.038 | " |
| 181 | 19 | RS - 1 | 2.0 | 1.88 | 0.193 | 0.043 | Comparative example |
| 182 | " | S - 28 | 2.0 | 1.86 | 0.154 | 0.042 | Present invention |
| 183 | 8 | RS - 1 | 2.0 | 1.85 | 0.202 | 0.052 | Comparative example |
| 184 | " | S - 28 | 2.0 | 1.92 | 0.159 | 0.051 | Present invention |
| 185 | 15 | RS - 1 | 2.0 | 1.87 | 0.182 | 0.040 | Comparative example |
| 186 | " | S - 28 | 2.0 | 1.94 | 0.138 | 0.039 | Present invention |
| 187 | 35 | RS - 1 | 2.0 | 1.70 | 0.152 | 0.058 | Comparative example |
| 188 | " | S - 28 | 2.0 | 1.78 | 0.127 | 0.062 | Present invention |
| 189 | 2 | RS -1 | 2.0 | 1.77 | 0.176 | 0.054 | Comparative example |
| 190 | " | S - 28 | 2.0 | 1.83 | 0.136 | 0.075 | Present invention |

In Table A, the o/c ratio represents the weight ratio of the high boiling point organic solvent to the coupler. It is apparent from Table A that the M and Y values were high when the comparative cyan coupler ExC-1 was used, and that the changes in these values due to the type or amount of the high boiling point organic solvent were very small. This demonstrates that the comparative coupler ExC-1 had large amounts of yellow and magenta components and was therefore poor in color reproducibility, and that it was not easy to largely improve the color reproducibility even by changing the type or amount of the high-boiling organic solvent.

On the other hand, the M value was greatly decreased while the Y value was kept low when the coupler of the present invention was dispersed in the high boiling point organic solvent of the present invention compared to the case in which it was dispersed in the comparative high boiling point organic solvent. This indicates that the cyan coupler of the present invention could reduce both the yellow and magenta components when used together with the high boiling point organic solvent of the present invention, achieving an excellent color reproducibility.

As described above, when dispersed in the high boiling point organic solvent of the present invention, the cyan coupler of the present invention can achieve its hue improving effect maximally.

This effect is particularly remarkable when phosphonic ester, phosphinic ester, and phosphine oxide are used as the high boiling point organic solvent of the present invention.

In addition, the same evaluation was performed for the coupler (ExC-3) described in JP-A-62-279340, and as a result it was confirmed that this coupler formed a magenta color and therefore could not be used as a cyan coupler.

It was also confirmed that the hue did not change in practice when the coupler ExC-3 was used in combination with the high boiling point organic solvent of the present invention.

EXAMPLE 2

After corona discharge treatment was performed on the surface of a paper support whose both surfaces were laminated with polyethylene, a gelatin subbing layer containing sodium dodecylbenzenesulfonate was formed on that surface. In addition, a variety of photographic constituting layers were coated on the support to make a multilayered color photographic printing paper (sample 201) having the following layer arrangement. The coating solutions were prepared as follows.

Preparation of coating solution of 5th layer 30.0 g of a cyan coupler (ExC), 18.0 g of an ultraviolet absorbent (UV-2), 30.0 g of a dye image stabilizer (Cpd-1), 15.0 g of a dye image stabilizer (Cpd-9), 15.0 g of a dye image stabilizer (Cpd-10), 1.0 g of a dye image stabilizer (Cpd-11), 1.0 g of a dye image stabilizer (Cpd-8), 1.0 g of a dye image stabilizer (Cpd-6), and 15.0 g of a solvent (Solv-2) were dissolved in 60.0 cc of ethyl acetate, and the resultant solution was added to 500 cc of an aqueous 20% gelatin solution containing 8 cc of sodium dodecylbenzenesulfonate. The resultant mixture was emulsion-dispersed by an ultrasonic homogenizer to prepare an emulsified dispersion. Separately, a silver chlorobromide emulsion (cubic, a 1:4 mixture (Ag molar ratio) of a large-size emulsion C with an average grain size of 0.50 μm and a small-size emulsion C with an average grain size of 0.41 μm. The variation coefficients of grain size distributions of the large- and small-size emulsions were 0.09 and 0.11, respectively. Each emulsion consisted of silver halide grains in which 0.8 mol % of AgBr was locally contained in a portion of the grain surface and the remainder was silver chloride). This emulsion was added with a red-sensitive sensitizing dye E and a compound F shown in Table 14. Chemical ripening of this emulsion was performed by adding a sulfur sensitizer and a gold sensitizer. The emulsified dispersion described above and this red-sensitive silver chlorobromide emulsion were mixed to prepare a coating solution of the 5th layer having the following composition.

The coating solutions of layers other than the 5th layer were prepared following the same procedures as for the coating solution of the 5th layer. 1-oxy-3,5-dichloro-s-triazine sodium salt was used as a gelatin hardener in each layer.

In addition, Cpd-14 and Cpd-15 were added to each layer such that their total amounts were 25.0 mg/m$^2$ and 50 mg/m$^2$, respectively.

Spectral sensitizing dyes shown below were used in the silver chlorobromide emulsion of each light-sensitive emulsion layer.

TABLE 12

Blue-sensitive emulsion layer

Sensitizing dye A

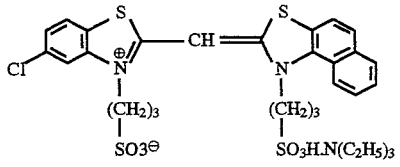

and

Sensitizing dye B

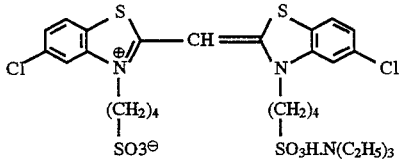

(each in 2.0 × 10$^{-4}$ mol for the large-size emulsion and 2.5 × 10$^{-4}$ mol for the small-size emulsion per mol of a silver halide)

TABLE 13

Green-sensitive emulsion layer

Sensitizing dye C

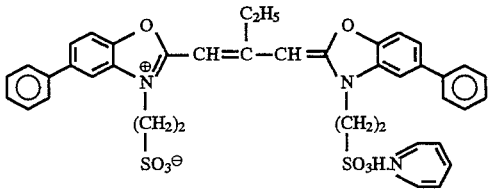

(4.0 × 10$^{-4}$ mol for the large-size emulsion and 5.6 × 10$^{-4}$ mol for the small-size emulsion per mol of a silver halide)

Sensitizing dye D

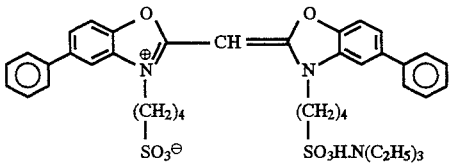

(7.0 × 10$^{-5}$ mol for the large-size emulsion and 1.0 × 10$^{-5}$ mol for the small-size emulsion per mol of a silver halide)

TABLE 14

Red-sensitive emulsion layer

Sensitizing dye E

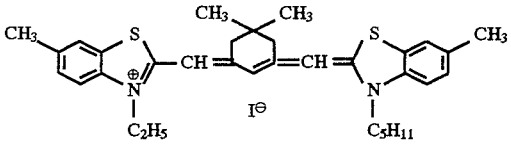

(0.9 × 10$^{-4}$ mol for the large-size emulsion and 1.1 × 10$^{-4}$ mol for the small-size emulsion per mol of a silver halide)

Compound F

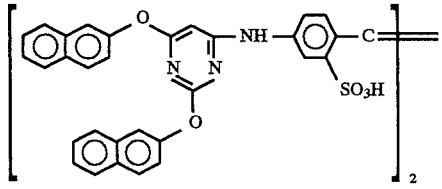

In addition, 1-(5-methylureidophenyl)-5-mercaptotetrazole was added to the blue-, green-, and red-sensitive emulsion layers in amounts of 8.5×10$^{-5}$ mol, 7.7×10$^{-4}$ mol, and 2.5×10$^{-4}$ mol, respectively, per mol of silver halide.

Also, 4-hydroxy-6-methyl-1,3,3a,7-tetrazaindene was added to the blue- and green-sensitive emulsion layers in amounts of 1×10$^{-4}$ mol and 2×10$^{-4}$ mol, respectively, per mol of silver halide.

Furthermore, to prevent irradiation, the following dye (the number given in parenthesis represents the coating amount) was added to the emulsion layers.

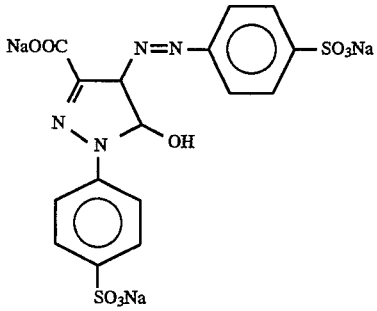

(10 mg/m²)

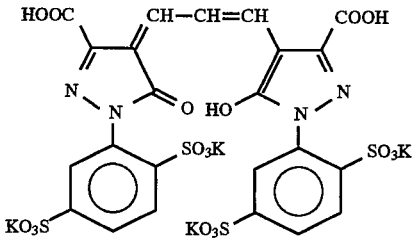

(10 mg/m²)

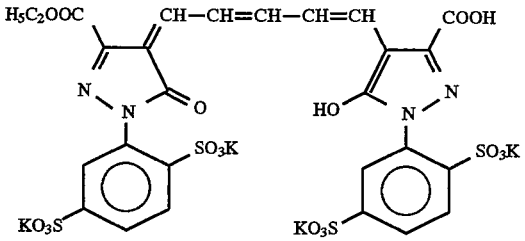

(40 mg/m²)

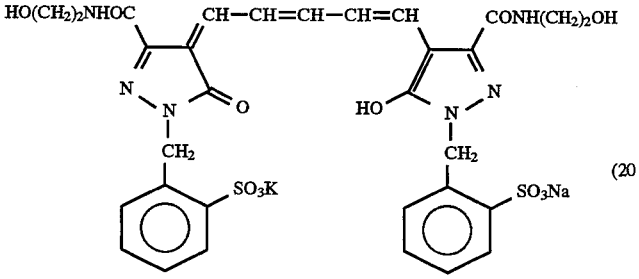

(20 mg/m²)

(Layer Arrangement)

The compositions of the individual layers are shown below. The number represents the coating amount (g/m²). The amount of each silver halide emulsion is represented by the coating amount of silver.

TABLE 15

| Support | |
|---|---|
| Polyethylene laminate paper [containing a white pigment ($TiO_2$) and a blue dye (ultramarine blue) in polyethylene on the 1st layer side] | |
| 1st layer (Blue-sensitive emulsion layer) | |
| Silver chlorobromide emulsion (cubic, a 3:7 mixture (molar ratio of silver) of a large-size emulsion A with an average grain size of 0.88 μm and a small-size emulsion A with that of 0.70 μm, the variation coefficients of grain size distributions of the large- and small-size emulsions were 0.08 and 0.10, respectively, and each emulsion consisted of silver halide grains in which 0.3 mol% of silver bromide was locally contained in a portion of a grain surface and the remainder was silver chloride) | 0.22 |
| Gelatin | 1.20 |
| Yellow coupler (ExY) | 0.65 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |

TABLE 15-continued

| Support | |
|---|---|
| Polyethylene laminate paper [containing a white pigment ($TiO_2$) and a blue dye (ultramarine blue) in polyethylene on the 1st layer side] | |
| 2nd layer (Color mixing inhibiting layer) | |
| Gelatin | 1.10 |
| Color mixing inhibitor (Cpd-4) | 0.08 |
| Solvent (Solv-7) | 0.04 |
| Solvent (Soly-2) | 0.30 |
| Solvent (Solv-3) | 0.30 |

TABLE 16

| 3rd layer (Green-sensitive emulsion layer) | |
|---|---|
| Silver chlorobromide emulsion (cubic, a 1:3 mixture (molar ratio of Ag) of a large-size emulsion B with an average grain size of 0.55 μm and a small-size emulsion B with that of 0.39 μm, the variation coefficients of grain size distributions of the large- and small-size emulsions were 0.10 and 0.08, respectively, and each emulsion consisted of silver chlorobromide grains in which 0.8 mol % of AgBr was locally contained in a portion of a grain surface and the remainder was AgCl | 0.13 |
| Gelatin | 1.45 |
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.01 |
| Dye image stabilizer (Cpd-7) | 0.01 |
| Dye image stabilizer (Cpd-B) | 0.08 |
| Solvent (Solv-3) | 0.50 |
| Solvent (Solv-4) | 0.15 |
| Solvent (Solv-5) | 0.15 |
| 4th layer (Color mixing inhibiting layer) | |
| Gelatin | 0.80 |
| Color mixing inhibitor agent (Cpd-4) | 0.06 |
| Solvent (Solv-7) | 0.03 |
| Solvent (Solv-2) | 0.20 |
| Solvent (Solv-3) | 0.20 |

TABLE 17

| 5rd layer (Red-sensitive emulsion layer) | |
|---|---|
| Silver chlorobromide emulsion (cubic, a 1:4 mixture (molar ratio of Ag) of a large-size emulsion C with an average grain size of 0.50 μm and a small-size emulsion C with that of 0.41 μm, the variation coefficients of grain size distributions of the large- and small-size emulsions were 0.09 and 0.11, respectively, and each emulsion consisted of silver chlorobromide grains in which 0.8 mol% of AgBr was locally contained in a portion of a grain surface) | 0.20 |
| Gelatin | 0.90 |
| Cyan coupler (ExC) | 0.30 |
| Ultraviolet absorber (UV-2) | 0.18 |
| Dye image stabilizer (Cpd-1) | 0.30 |
| Dye image stabilizer (Cpd-9) | 0.01 |
| Dye image stabilizer (Cpd-10) | 0.01 |
| Dye image stabilizer (Cpd-11) | 0.01 |
| Solvent (Solv-2) | 0.15 |
| Dye image stabilizer (Cpd-8) | 0.01 |
| Dye image stabilizer (Cpd-6) | 0.01 |
| 6th layer (Ultraviolet absorbing layer) | |
| Gelatin | 0.55 |
| Ultraviolet absorber (UV-1) | 0.38 |
| Dye image stabilizer (Cpd-12) | 0.15 |
| Dye image stabilizer (Cpd-5) | 0.02 |

TABLE 18

| 7rd layer (Protective layer) | |
|---|---|
| Gelatin | 1.13 |
| Acryl-modified polyvinyl alcohol copolymer (modification degree: 17%) | 0.05 |
| Liquid paraffin | 0.02 |
| Dye image stabilizer (Cpd-13) | 0.01 |

The compounds used are indicated below.

(ExY) Yellow coupler

A 1:1 mixture (molar ratio) of

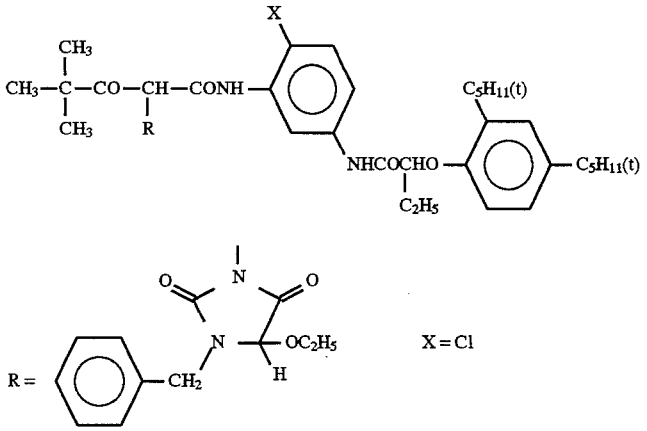

-continued
and
R = 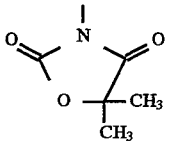 X = $OCH_3$
(ExM) Magenta coupler
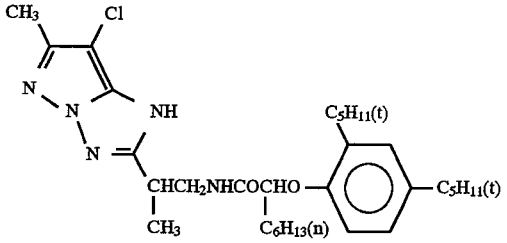
(ExC) Cyan coupler
A 3:7 mixture (molar ratio) of
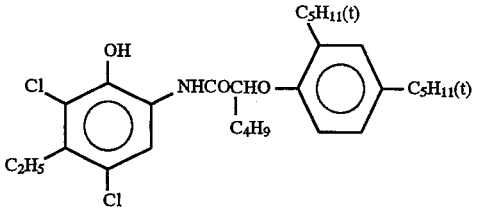
and
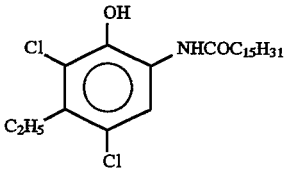
(Cpd-1) Dye image stabilizer
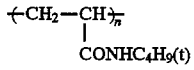 average molecular weight 60,000
(Cpd-2) Dye image stabilizer
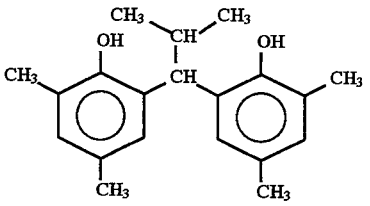
(Cpd-3) Dye image stabilizer
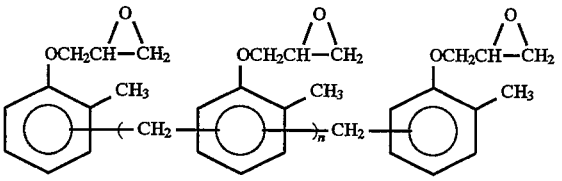
n = 7 to 8 (average value)

-continued
(Cpd-4) Color mixing inhibitor
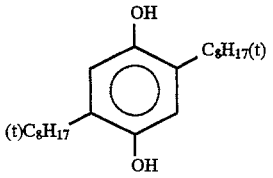
(Cpd-5) Dye image stabilizer
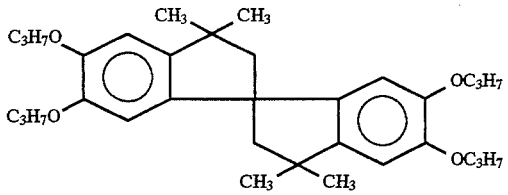
(Cpd-6) Dye image stabilizer
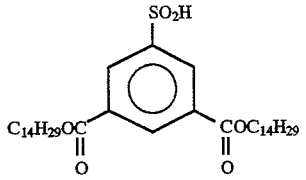
(Cpd-7) Dye image stabilizer
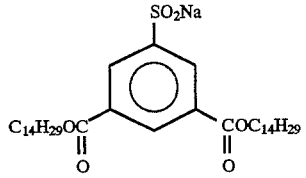
(Cpd-8) Dye image stabilizer
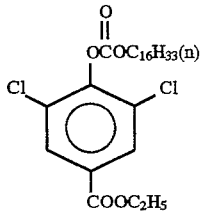
(Cpd-9) Dye image stabilizer
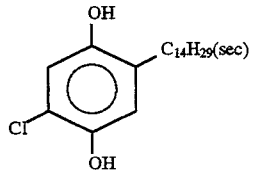
(Cpd-10) Dye image stabilizer
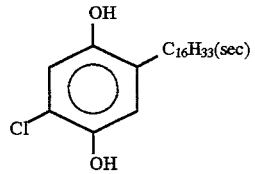
(Cpd-11) Dye image stabilizer -continued
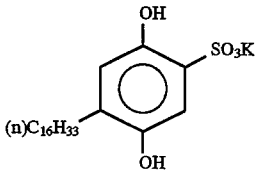
(Cpd-12)
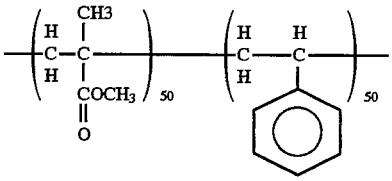
average molecular weight 60,000
(Cpd-13)
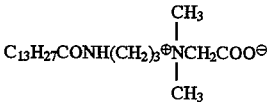
(Cpd-14) Preservative
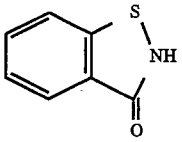
(Cpd-15) Preservative
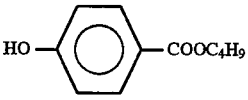
(UV-1) Ultraviolet absorbent
A 1:5:10:5 mixture (weight ratio) of (i), (ii), (iii) and (iv) below:
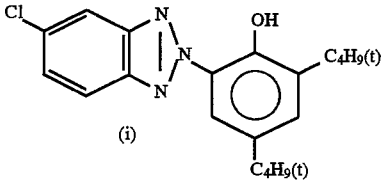
(i)
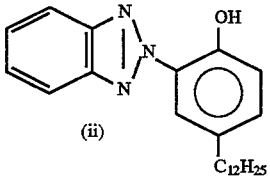
(ii)
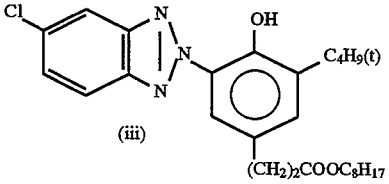
(iii)

-continued
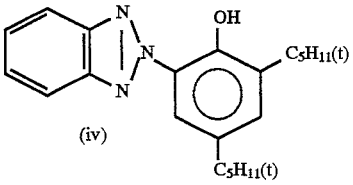
(iv)
(UV-2) Ultraviolet absorbent
A 1:2:2 mixture (weight ratio) of (v), (vi) and (vii) below:
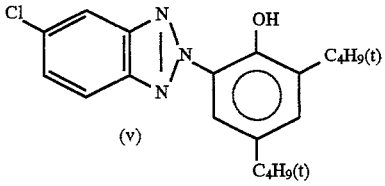
(v)
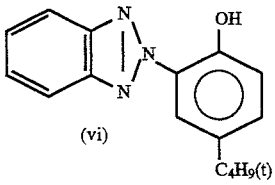
(vi)
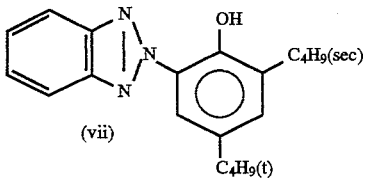
(vii)
(Solv-1) Solvent
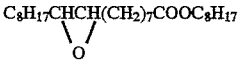
(Solv-2) Solvent
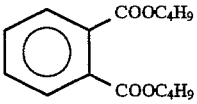
(Solv-3) Solvent
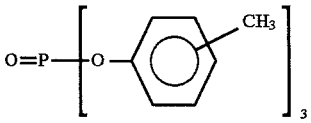
(Solv-4) Solvent
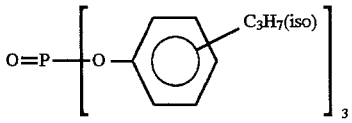
(Solv-5) Solvent
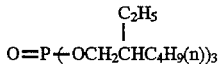
(Solv-6) Solvent -continued

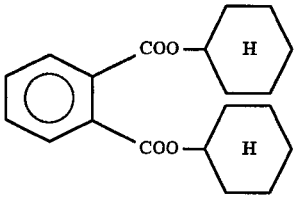

(Solv-7) Solvent

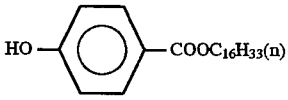

Subsequently, samples 202 to 245 were made by replacing the cyan coupler (ExC) and the high boiling point organic solvent (Solv-2) in the red-sensitive emulsion layer of the sample 201 with the compounds of the present invention listed in Table B. Note that these samples were made following the same procedures as for the sample 201 except that when the pyrroloazole-based coupler of the present invention was used as the cyan coupler, the coating amounts of the coupler and the silver halide emulsion were changed to 50 mol % and 80 mol %, respectively.

These samples were used after stored at room temperature (about 20° C.) for 20 days.

The sample 201 was subjected to gray exposure by using a sensitometer (available from Fuji Photo Film Co., Ltd., FWH type, color temperature of light source 3,200° K.) such that approximately 30% of the coated silver amount were developed.

The sample thus exposed was subjected to continuous processing by using a paper processor in accordance with the processing steps using the processing solutions presented below, thereby making a development condition in a running equilibrium state.

TABLE 19

| Processing step | Temperature | Time | Replenisher* | Tank volume |
|---|---|---|---|---|
| Color development | 35° C. | 45 sec | 161 ml | 17 l |
| Bleach-fixing | 30–35° C. | 45 sec | 215 ml | 17 l |
| Rinsing (1) | 30° C. | 90 sec | 350 ml | 10 l |
| Drying | 70–80° C. | 60 sec | | |

*The quantity of replenisher is represented by a value per $m^2$ of a light-sensitive material.

The compositions of the individual processing solutions were as follows.

TABLE 20

| Color developing solution | Tank solution | Replenisher* |
|---|---|---|
| Water | 800 ml | 800 ml |
| Ethylenediamine-N,N,N,N-tetramethylenephosphonic acid | 1.5 g | 2.0 g |
| Potassium bromide | 0.015 g | |
| Triethanolamine | 8.0 g | 12.0 g |
| Sodium chloride | 1.4 g | |
| Potassium carbonate | 25 g | 25 g |
| N-ethyl-N-(P-methanesulfonamidoethyl)-3-methyl-4-aminoanilino sulfate | 5.0 g | 7.0 g |
| N,N-bis(carboxymethyl)hydrazine | 4.0 g | 5.0 g |

TABLE 20-continued

| Color developing solution | Tank solution | Replenisher* |
|---|---|---|
| N,N-di(sulfoethyl)hydroxylamine.1 Na | 4.0 g | 5.0 g |
| Fluorescent brightener (WHITEX 4B, available from SUMITOMO CHEMICAL CO., LTD.) | 1.0 g | 2.0 g |
| Water to make | 1000 ml | 1000 ml |
| pH (25° C.) | 10.05 | 10.45 |

TABLE 21

| Bleach-fixing solution (tank solution and replenisher and the same) | |
|---|---|
| Water | 400 ml |
| Sodium thiosulfate (70%) | 100 ml |
| Sodium sulfite | 17 g |
| Ammonium iron (III) ethylenediaminetetraacetate | 55 g |
| Disodium ethylenediaminetetraacetate | 5 g |
| Ammonium bromide | 40 g |
| Water to make | 1000 ml |
| pH (25° C.) | 6.0 |
| **Rinsing solution (tank solution and replenisher are the same)** | |
| Ion exchange water (amount of each of calcium and magnesium was 3 ppm or less) | |

Subsequently, gradation exposure was given to each sample through a sensitometry three color separation optical wedge by using the sensitometer (available from Fuji Photo Film Co., Ltd., FWH type, color temperature of light source 3,200° K.). In this case, the exposure was performed such that an exposure amount of 250 CMS was obtained for an exposure time of 0.1 second.

Each exposed sample was subjected to continuous processing using the above running solutions by using the paper processor. After the processing, measurements of the red, green, and blue optical densities were performed for the cyan-colored portion (red light-exposed portion) of each sample following the same procedures as in Example 1, thereby forming sensitometry curves. From these sensitometry curves, the maximum color density Dmax, the yellow component Y, and the magenta component M were obtained following the same procedures as in Example 1. Note that the Y and M values were calculated from the blue and green optical densities at red optical density R=1.5.

The obtained results are summarized in Table B.

TABLE B

| Sample No. | Coupler | High boiling point organic solvent Type | o/c ratio | $D_{max}$ | Hue M | Hue Y | Remarks |
|---|---|---|---|---|---|---|---|
| 201 | ExC | Solv-2 | 0.5 | 2.21 | 0.27 | 0.18 | Comparative example |
| 202 | " | " | 1.0 | 2.41 | 0.26 | 0.16 | " |
| 203 | " | " | 2.0 | 2.46 | 0.26 | 0.16 | " |
| 204 | " | " | 4.0 | 2.25 | 0.27 | 0.17 | |
| 205 | " | Solv-6 | 1.0 | 2.35 | 0.26 | 0.16 | |
| 206 | " | S-2 | 0.5 | 2.07 | 0.29 | 0.20 | " |
| 207 | " | " | 1.0 | 2.39 | 0.26 | 0.16 | " |
| 208 | " | " | 2.0 | 2.42 | 0.26 | 0.17 | " |
| 209 | " | " | 4.0 | 2.31 | 0.27 | 0.18 | " |
| 210 | " | S-25 | 2.0 | 2.35 | 0.26 | 0.17 | " |
| 211 | " | S-34 | 2.0 | 2.26 | 0.27 | 0.18 | " |
| 212 | " | S-40 | 2.0 | 2.25 | 0.27 | 0.18 | " |
| 213 | 21 | Solv-2 | 1.0 | 2.35 | 0.27 | 0.10 | " |
| 214 | " | " | 2.0 | 2.41 | 0.27 | 0.09 | " |
| 215 | " | " | 4.0 | 2.39 | 0.26 | 0.10 | " |
| 216 | " | S-2 | 0.5 | 2.37 | 0.25 | 0.10 | Present invention |
| 217 | " | " | 1.0 | 2.48 | 0.23 | 0.09 | " |
| 218 | " | " | 2.0 | 2.51 | 0.22 | 0.09 | " |
| 219 | " | " | 4.0 | 2.52 | 0.21 | 0.08 | " |
| 220 | " | " | 6.0 | 2.52 | 0.20 | 0.09 | |
| 221 | " | S-25 | 0.5 | 2.49 | 0.23 | 0.10 | |
| 222 | " | " | 1.0 | 2.50 | 0.21 | 0.09 | " |
| 223 | " | " | 2.0 | 2.50 | 0.20 | 0.09 | " |
| 224 | " | " | 4.0 | 2.52 | 0.19 | 0.09 | " |
| 225 | " | S-34 | 0.5 | 2.47 | 0.22 | 0.10 | " |
| 226 | " | " | 1.0 | 2.51 | 0.21 | 0.09 | " |
| 227 | " | " | 2.0 | 2.52 | 0.20 | 0.09 | " |
| 228 | " | " | 4.0 | 2.52 | 0.18 | 0.08 | " |
| 229 | " | S-40 | 0.5 | 2.49 | 0.22 | 0.10 | " |
| 230 | " | " | 1.0 | 2.52 | 0.20 | 0.09 | " |
| 231 | " | " | 2.0 | 2.52 | 0.19 | 0.09 | " |
| 232 | " | " | 4.0 | 2.52 | 0.18 | 0.09 | " |
| 233 | " | S-2 | 2.0 | 2.53 | 0.20 | 0.09 | " |
| | | S-25 | 1.0 | | | | |
| 234 | " | S-2 | 2.0 | 2.53 | 0.19 | 0.09 | " |
| | | S-25 | 1.0 | | | | |
| 235 | " | S-2 | 2.0 | 2.52 | 0.20 | 0.09 | " |
| | | S-34 | 1.0 | | | | |
| 236 | " | S-2 | 2.0 | 2.53 | 0.18 | 0.09 | " |
| | | S-34 | 2.5 | | | | |
| 237 | " | S-2 | 2.0 | 2.51 | 0.19 | 0.09 | " |
| | | S-40 | 1.0 | | | | |
| 238 | " | S-2 | 2.0 | 2.52 | 0.19 | 0.09 | " |
| | | S-40 | 2.0 | | | | |
| 239 | 14 | Solv-2 | 2.0 | 2.39 | 0.26 | 0.10 | Comparative example |
| 240 | " | S-2 | 2.0 | 2.45 | 0.23 | 0.10 | Present invention |
| 241 | | S-2 | 1.0 | 2.44 | 0.21 | 0.10 | " |
| | | S-25 | 1.0 | | | | |
| 242 | " | S-2 | 1.5 | 2.44 | 0.20 | 0.10 | " |
| | " | S-34 | 0.5 | | | | |
| 243 | " | S-2 | 1.5 | 2.42 | 0.20 | 0.10 | " |
| | " | S-40 | 0.5 | | | | |
| 244 | 20 | Solv-2 | 2.0 | 2.50 | 0.25 | 0.10 | Comparative example |
| 245 | " | S-2 | 2.0 | 2.53 | 0.20 | 0.09 | Present invention |
| | | S-34 | 1.0 | | | | |

As can be seen from Table B, substantially the same results as in Example 1 could be obtained in this example. That is, when dispersed in the phosphorus compound-based high boiling point organic solvent of the present invention, the cyan coupler of the present invention could reduce the M and Y values, exhibiting a better hue. The effect of improving hue was more startling when the phosphonic ester-based, phosphinic ester-based, or phosphine oxide-based compound was used, and the compound was effective even with a small use amount. The larger the amount of the high boiling point organic solvent, the greater the improving effect. The o/c ratio was preferably 1.0 or more for phosphoric ester, and 0.5 or more for phosphonic ester, phosphinic ester, and phosphine oxide.

Samples were further made by replacing the yellow coupler (ExY) in the 1st layer (blue-sensitive emulsion layer) of the samples 201 to 230 with an equal molar quantity of ExY-2 and decreasing the coating amount of the first layer containing the coupler to 80% without changing its composition, and the same evaluations were performed. Also in this case, substantially the same results as in Table B were obtained.

Yellow coupler

A 1:1 mixture (molar ratio) of

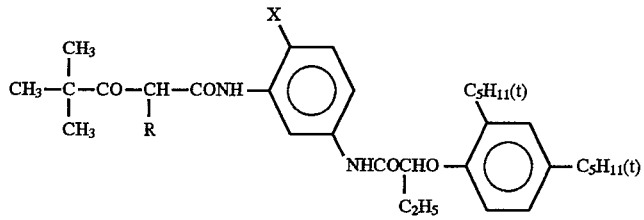

(ExY)

R = 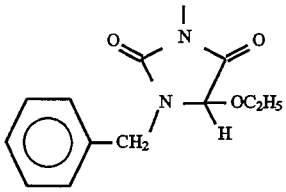 X = Cl and

R = 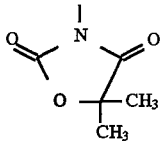 X = $OCH_3$

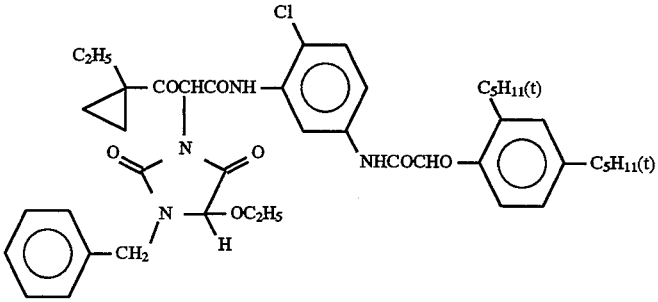

(ExY-2)

EXAMPLE 3

Samples corresponding to those of Example 2 were made following the same procedures as for the light-sensitive material of the sample 601 of Example 6 described in JP-A-2-139544 except that the cyan couplers C-1, C-2, and C-3 and the high boiling point organic solvents in the 4th to 6th layers were replaced with the couplers and the high boiling point organic solvents listed in Table B of Example 2.

These samples were processed in the same manner as in JP-A-2-139544 and evaluated following the same procedures as in Example 1. As a result, the effect of improving hue was obtained by the combinations of the present invention as in Example 1.

In addition, samples were made by replacing the yellow coupler C-6 in the 16th and 17th layers of the above samples with C-10 and replacing C-4 and C-7 in the 9th to 11th layers with C-8 and were similarly evaluated.

Also in this case, the hue improving effect was obtained by the combinations of the present invention as in Example 1.

C-8

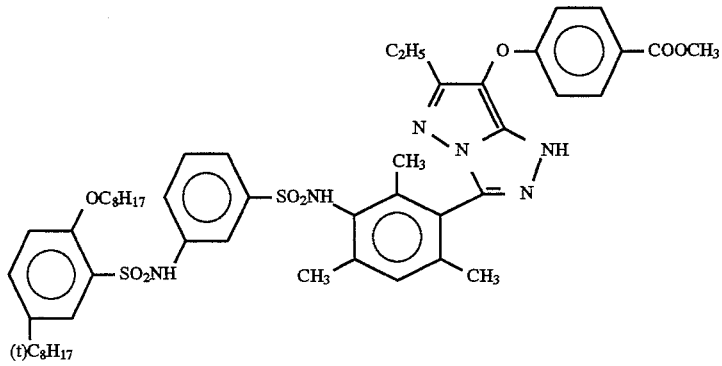

C-10

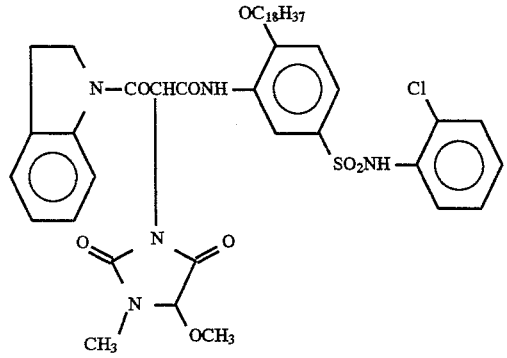

As has been described above, the present invention can provide a color photographic light-sensitive material having good color forming properties and a high color reproducibility.

What is claimed is:

1. A silver halide color photographic light-sensitive material having at least a silver halide emulsion layer containing a cyan dye-forming coupler on a support, wherein said silver halide emulsion layer containing the cyan dye-forming coupler contains at least one cyan dye-forming coupler represented by Formula (IIIa) below and at least one high boiling point organic solvent having a melting point of 100° C. or less and represented by Formula (S) below:

Formula (IIIa)

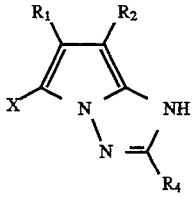

where each of $R_1$ and $R_2$ represents an electron-withdrawing group with a Hammett's substituent constant $\sigma_p$ value of not less than 0.20, the sum of the $\sigma_p$ values of $R_1$ and $R_2$ is not less than 0.65, $R_4$ represents a hydrogen atom or a substituent, and X represents a hydrogen atom or a group that splits off upon a coupling reaction with an oxidized form of an aromatic primary amine color developing agent;

Formula (S)

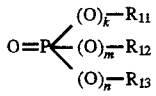

where each of $R_{11}$, $R_{12}$, and $R_{13}$ represents an alkyl group, a cycloalkyl group, or an aryl group, and each of k, m, and n represents 1 or 0, with the proviso that at least one of k, m, and, n is zero.

2. The material according to claim 1, wherein a weight ratio of a high boiling point organic solvent represented by Formula (S) to a cyan dye-forming coupler represented by Formula (IIIa) is not less than 1.0.

3. The material according to claim 1, wherein a weight ratio of a high boiling point organic solvent represented by Formula (S) to a cyan dye-forming coupler represented by Formula (IIIa) is not less than 0.5.

4. The material according to claim 1, wherein said silver halide emulsion layer containing a cyan dye-forming coupler is a red-sensitive emulsion layer.

5. The material according to claim 1, wherein the total content of the cyan dye-forming couplers of Formula (IIIa) in the silver halide emulsion layer ranges from $1\times10^{-3}$ to 1 mole per mole of silver halide.

6. The material according to claim 1, wherein $R_2$ is a straight or branched unsubstituted alkoxycarbonyl group, an alkoxycarbonyl group substituted with a carbamoyl group, an ether linkage-containing alkoxycarbonyl group, an unsubstituted aryloxycarbonyl group or an alkyl- or alkoxy-substituted aryloxycarbonyl group.

7. The material according to claim 1, wherein the silver halide emulsion layer comprises a substantially iodide-free silver chloride or chlorobromide emulsion having a chloride content of at least 90 mole %.

8. The material according to claim 1, wherein $R_4$ is a substituent selected from the group consisting of a halogen atom, an aliphatic group, an aryl group, a heterocyclic group, an alkoxy group, an aryloxy group, a heterocyclicoxy group, an alkylthio group, an arylthio group, a heterocyclic thio group, an acyloxy group, a carbamoyloxy group, a silyloxy group, a sulfonyloxy group, an acylamino group, an alkylamino group, an arylamino group, a ureido group, a sulfamoylamino group, an alkenyloxy group, a formyl group, an alkylacyl group, an arylacyl group, a heterocyclic acyl group, an alkylsulfonyl group, an arylsulfonyl group, a heterocyclic sulfonyl group, an alkylsulfinyl group, an arylsulfinyl group, a heterocyclic sulfinyl group, an alkyloxycarbonyl group, an aryloxycarbonyl group, a heterocyclic oxycarbonyl group, an alkyloxycarbonylamino group, aryloxycarbonylamino group, a heterocyclic oxycarbonylamino group, a sulfonamido group, a carbamoyl group, a sulfamoyl group, a phosphonyl group, a sulfamido group, an imido group, an azolyl group, a hydroxy group, a cyano group, a carboxy group, a nitro group, a sulfo group, and an unsubstituted amino group.

9. The material according to claim 1, wherein $R_4$ is selected from the group consisting of an alkyl group, an aryl group, a heterocyclic group, a cyano group, a nitro group, an acylamino group, an arylamino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryloxycarbonyl group, a heterocyclicoxy group, an acyloxy group, a carbamoyloxy group, an aryloxycarbonylamino group, an imido group, a heterocyclic thio group, a sulfinyl group, a phosphonyl group, an acyl group, and an azolyl group.

10. The material according to claim 1, wherein each of $R_{11}$, $R_2$, and $R_{13}$ is an alkyl group having a total carbon atom number of 1 to 24, a cycloalkyl group having a total carbon atom number of 5 to 24, or an aryl group having a total carbon atom number of 6 to 24.

11. The material according to claim 1, wherein $R_{11}$, $R_{12}$ or $R_{13}$ represents a substituted or unsubstituted alkyl group selected from the group consisting of n-butyl, 2-ethylhexyl, 3,3,5-trimethylhexyl, n-dodecyl, n-octadecyl, benzyl, oleyl, 2-chloroethyl, 2,3-dichloropropyl, 2-butoxyethyl, and 2-phenoxyethyl.

12. The material according to claim 1, wherein $R_{11}$, $R_{12}$ or $R_{13}$ represents a cycloalkyl group selected from the group consisting of cyclopentyl, cyclohexyl, 4-t-butylcyclohexyl, 4-methylcyclohexyl, and 2-cyclohexenyl.

13. The material according to claim 1, wherein $R_{11}$, $R_{12}$ or $R_{13}$ represents an aryl group selected from the group consisting of phenyl, cresyl, p-nonylphenyl, xylyl, cumenyl, p-methoxyphenyl, and p-methoxycarbonylphenyl.

14. The material according to claim 1, wherein the weight ratio of the high-boiling point organic solvent of Formula (S), in which at least one of k, m and n is 0, to the coupler of Formula (IIIa) is 0.5 to 5.

15. The silver halide color photographic light-sensitive material according to claim 1, where each of $R_1$ and $R_2$ represents a cyano group, an alkoxycarbonyl group or an aryloxycarbonyl group.

16. A silver halide color photographic light-sensitive material having at least a silver halide emulsion layer containing a cyan dye-forming coupler on a support, wherein said silver halide emulsion layer containing the cyan dye-forming coupler contains at least one cyan dye-forming coupler represented by Formula (III'a) below and at least one high boiling point organic solvent having a melting point of 100° C. or less and represented by Formula (S') below:

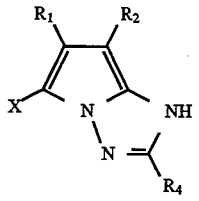

Formula (III'a)

where $R_1$ represents a cyano group and $R_2$ represents an alkoxycarbonyl group or an aryloxycarbonyl group, $R_4$ represents a hydrogen atom or a substituent, and X represents a hydrogen atom or a group that splits off upon a coupling reaction with an oxidized form of an aromatic primary amine color developing agent;

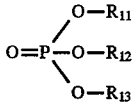

Formula (S')

where each of $R_{11}$, $R_{12}$, and $R_{13}$ represents an unsubstituted alkyl group, a substituted alkyl group, a cycloalkyl group, or an aryl group, where a substituent of the substituted alkyl group is selected from the group consisting of a halogen atom, an aryl, an alkoxy, an aryloxy, an alkoxycarbonyl, a hydroxyl, an acyloxy, an epoxy, a phosphorous ester moiety, a hypophosphorous ester moiety and a phosphine oxide moiety.

17. The material according to claim 16, wherein the weight ratio of the high-boiling point organic solvent of Formula (S'), in which all of k, m and n is 1, to the coupler of Formula (III'a) is 1 to 10.

18. The material according to claim 16, wherein a weight ratio of a high boiling point organic solvent represented by Formula (S') to a cyan dye-forming coupler represented by Formula (III'a) is not less than 1.0.

19. The material according to claim 16, wherein a weight ratio of a high boiling point organic solvent represented by Formula (S') to a cyan dye-forming coupler represented by Formula (III'a) is not less than 0.5.

20. The material according to claim 16, wherein said silver halide emulsion layer containing a cyan dye-forming coupler is a red-sensitive emulsion layer.

21. The material according to claim 16, wherein the total content of the cyan dye-forming couplers of Formula (III'a) in the silver halide emulsion layer ranges from $1\times10^{-3}$ to 1 mole per mole of silver halide.

22. The material according to claim 16, wherein the silver halide emulsion layer comprises a substantially iodide-free silver chloride or chlorobromide emulsion having a chloride content of at least 90 mole %.

23. The material according to claim 16, wherein $R_4$ is a substituent selected form the group Consisting of a halogen atom, an aliphatic group, an aryl group, a heterocyclic group, an alkoxy group, an aryloxy group, a heterocyclicoxy group, an alkylthio group, an arylthio group, a heterocyclic thio group, an acyloxy group, a carbamoyloxy group, a silyloxy group, a sulfonyloxy group, an acylamino group, an alkylamino group, an arylamino group, a ureido group, a sulfamoylamino group, an alkenyloxy group, a formyl group, an alkylacyl group, an arylacyl group, a heterocyclic acyl group, an alkylsulfonyl group, an arylsulfonyl group, a heterocyclic sulfonyl group, an alkylsulfinyl group, an arylsulfinyl group, a heterocyclic sulfinyl group, an alkyloxycarbonyl group, an aryloxycarbonyl group, a heterocyclic oxycarbonyl group, an alkyloxycarbonylamino group, an aryloxycarbonylamino group, a heterocyclic oxycarbonylamino group, a sulfonamido group, a carbamoyl group, a sulfamoyl group, a phosphonyl group, a sulfamido group, an imido group, an azolyl group, a hydroxy group, a cyano group, a carboxy group, a nitro group, a sulfo group, and an unsubstituted amino group.

24. The material according to claim 16, wherein $R_4$ is selected from the group consisting of an alkyl group, an aryl group, a heterocyclic group, a cyano group, a nitro group, an acylamino group, an arylamino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryloxycarbonyl group, a heterocyclicoxy group, an acyloxy group, a carbamoyloxy group, an aryloxycarbonylamino group, an imido group, a heterocyclic thio group, a sulfinyl group, a phosphonyl group, an acyl group, and an azolyl group.

25. The material according to claim 16, wherein each of $R_{11}$, $R_{12}$, and $R_{13}$ is an alkyl group having a total carbon atom number of 1 to 24, a cycloalkyl group having a total carbon atom number of 5 to 24, or an aryl group having a total carbon atom number of 6 to 24.

26. The material according to claim 16, wherein $R_{11}$, $R_{12}$ or $R_{13}$ represents a substituted or unsubstituted alkyl group selected from the group consisting of n-butyl, 2-ethylhexyl, 3,3,5-trimethylhexyl, n-dodecyl, n-octadecyl, benzyl, oleyl, 2-chloroethyl, 2,3-dichloropropyl, 2-butoxyethyl, and 2-phenoxyethyl.

27. The material according to claim 16, wherein $R_{11}$, $R_{12}$ or $R_{13}$ represents a cycloalkyl group selected from the group consisting of cyclopentyl, cyclohexyl, 4-t-butylcyclohexyl, 4-methylcyclohexyl, and 2-cyclohexenyl.

28. The material according to claim 16, wherein $R_{11}$, $R_{12}$ or $R_{13}$ represents an aryl group selected from the group consisting of phenyl, cresyl, p-nonylphenyl, xylyl, cumenyl, p-methoxyphenyl, and p-methoxycarbonylphenyl.

* * * * *